US011505934B2

(12) United States Patent
Gupta

(10) Patent No.: US 11,505,934 B2
(45) Date of Patent: Nov. 22, 2022

(54) UNIVERSAL PORT FOR A BIDET WASHING APPARATUS

(71) Applicant: Anjum Gupta, San Diego, CA (US)

(72) Inventor: Anjum Gupta, San Diego, CA (US)

( * ) Notice: Subject to any disclaimer, the term of this patent is extended or adjusted under 35 U.S.C. 154(b) by 255 days.

(21) Appl. No.: 16/535,656

(22) Filed: Aug. 8, 2019

(65) Prior Publication Data

US 2021/0040719 A1 Feb. 11, 2021

(51) Int. Cl.
*E03D 9/08* (2006.01)
*A47K 10/22* (2006.01)
*A47K 4/00* (2006.01)

(52) U.S. Cl.
CPC ..... *E03D 9/08* (2013.01); *A47K 4/00* (2013.01); *A47K 10/22* (2013.01)

(58) Field of Classification Search
CPC ..... E03D 9/08; E03D 9/085; Y10T 403/7094; F16B 5/0052; A47K 10/20; A47K 10/22
USPC ..... 248/223.41, 224.51, 224.61, 224.7, 248/225.11
See application file for complete search history.

(56) References Cited

U.S. PATENT DOCUMENTS 1,252,207 A * 1/1918 Walker ..... 248/224.51
4,074,872 A * 2/1978 Marshall, Jr. ..... A47K 10/3836 242/597.7
4,441,219 A * 4/1984 Epstein ..... E03D 9/08 4/420.4
4,607,809 A * 8/1986 Sineni ..... A47K 10/22 242/560
5,035,389 A * 7/1991 Wang ..... F16B 3/00 248/224.51
6,811,348 B1 * 11/2004 Meyer ..... F16M 11/041 403/325
10,138,917 B2 * 11/2018 Koch ..... F16B 5/0614
2006/0186304 A1 * 8/2006 McGee ..... A47G 1/1606 248/476
2009/0166487 A1 * 7/2009 Pollack ..... A47K 10/38 248/201
2014/0319298 A1 * 10/2014 O'Regan ..... B60R 9/048 248/224.7
2017/0152654 A1 * 6/2017 Suggs ..... A47K 13/26

FOREIGN PATENT DOCUMENTS

DE 4308269 A1 * 9/1994 ..... E03D 11/025
JP H11206615 A * 8/1999

* cited by examiner

*Primary Examiner* — Joshua T Kennedy

(57) ABSTRACT

A universal port for attaching bathroom accessories to a bidet washing apparatus and a method of attaching the same is disclosed. In an embodiment, the universal port includes a rail unit attachable to the bidet washing apparatus; and a slider unit reversibly, slidably attachable to the rail unit. In another embodiment, the universal port includes a slider unit attachable to the bidet washing apparatus; and a rail unit reversibly, slidably attachable to the slider unit.

11 Claims, 20 Drawing Sheets

UNIVERSAL PORT FOR A BIDET WASHING APPARATUS

CROSS-REFERENCE TO RELATED APPLICATIONS

This application hereby incorporates by reference the disclosure U.S. patent application Ser. No. 15/165,789, titled: "ADJUSTABLE HINGE FASTENERS FOR USE WITH A BIDET WASHING APPARATUS," filed on May 26, 2016, the entire disclosure of which is hereby incorporated by reference in its entirety for all purposes.

FIELD OF THE INVENTION

The disclosure generally relates to a bidet washing apparatus, and more particularly to a bidet washing apparatus having a universal port for attaching convenient amenities for use in a bathroom situation.

BACKGROUND OF THE INVENTION

A bidet apparatus for washing and cleaning body parts, e.g., genital and/or anal, was initially developed in the form of a bidet that provided a single spray of water and was permanently built into the toilet bowl. However, such bidets were expensive and a new generation of bidets was developed that were attachable to the toilet, and included a plurality of nozzles for multiple water sprays. Such bidets can be attached to the seat of an existing toilet bowl for washing the private parts of a person sitting on it, using washing water sprayed from the bidet nozzles, without the use of toilet paper. Such bidets can include a plurality of nozzles for washing the private parts as well as the bidet itself.

Various bidet designs have addressed some of the desired effects, such as washing, washing with temperature-regulated water, and drying. However, existing bidets fail to address all concerns related to the designs and functions in the general field of bidets. This is particularly important in bidets used, for example, by infirm or sick people who may have special needs or require certain conveniences for their health and hygiene. Therefore, there remains a need to provide bidets with a means for attaching convenient amenities for use in a bathroom situation.

SUMMARY OF THE INVENTION

The disclosed embodiments are directed to solving one or more of the problems presented in the prior art, described above, as well as providing additional features that will become readily apparent by reference to the following detailed description when taken in conjunction with the accompanying drawings.

In an embodiment, the disclosure provides a universal port for a bidet washing apparatus, which includes a rail unit having a proximal end and a distal end, wherein the rail unit is attachable to the bidet washing apparatus; and a slider unit having a proximal end and a distal end, wherein the slider unit is reversibly, slidably attachable to the rail unit.

In another embodiment, the disclosure provides a universal port for a bidet washing apparatus, which includes a slider unit having a proximal end and a distal end, wherein the slider unit is attachable to the bidet washing apparatus; and a rail unit having a proximal end and a distal end, wherein the rail unit is reversibly, slidably attachable to the slider unit.

In yet another embodiment, the disclosure provides a method of attaching a bathroom accessory unit to a bidet washing apparatus, by attaching one or more bathroom accessory units to the bidet washing apparatus using a universal port as described herein.

Further features and advantages of the disclosure, as well as the structure and operation of various embodiments of the disclosure, are described in detail below with reference to the accompanying drawings.

BRIEF DESCRIPTION OF THE DRAWINGS

The disclosure, in accordance with one or more various embodiments, is described in detail with reference to the following figures. The drawings are provided for purposes of illustration only and merely depict exemplary embodiments of the disclosure. These drawings are provided to facilitate the reader's understanding of the disclosure and should not be considered limiting of the breadth, scope, or applicability of the disclosure. It should be noted that for clarity and ease of illustration these drawings are not necessarily made to scale.

DETAILED DESCRIPTION OF EXEMPLARY EMBODIMENTS

Figure 1:
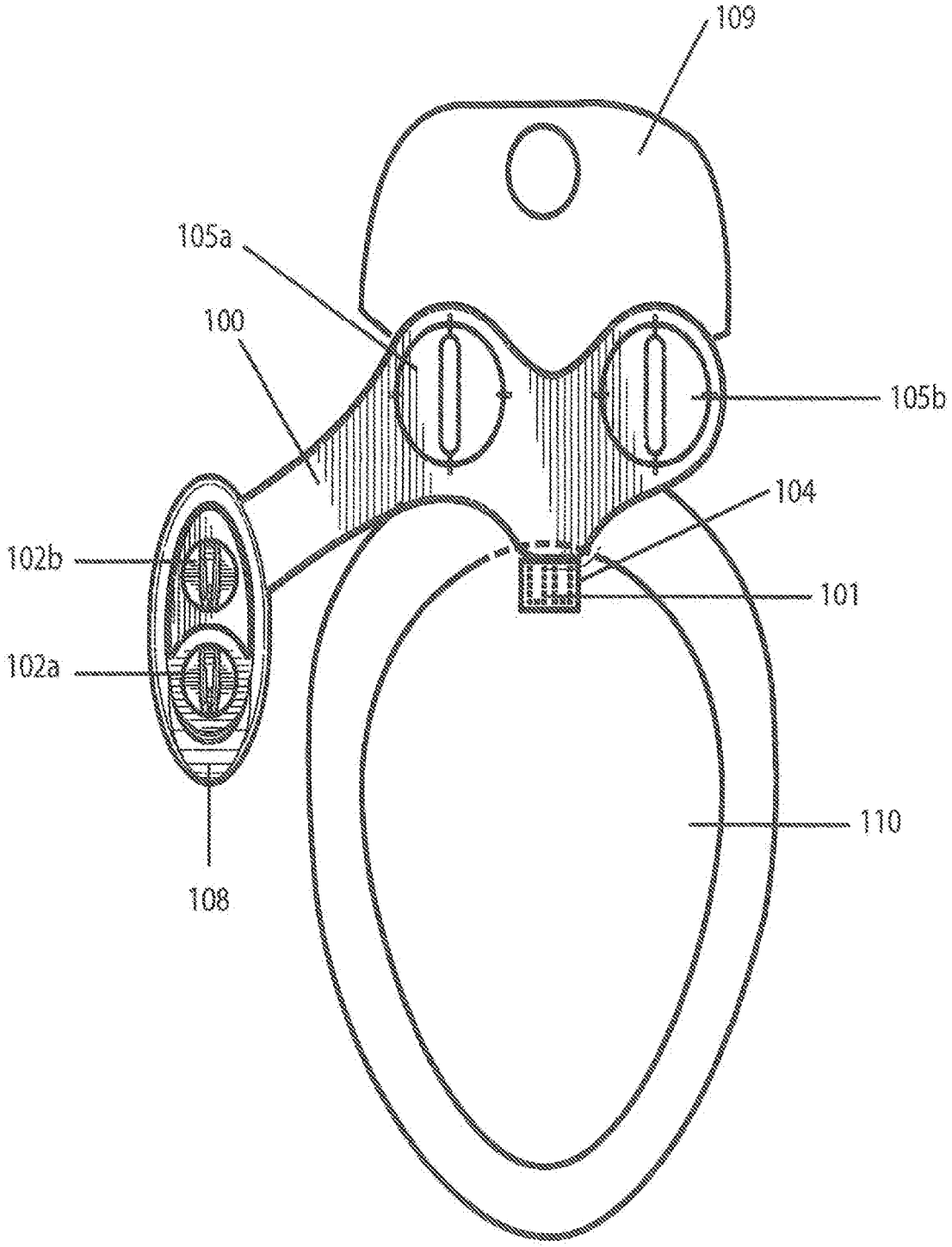
FIG. 1 illustrates an embodiment of a perspective view of an exemplary bidet washing apparatus installed on an existing toilet seat, with the seat cover up.

The following description is presented to enable a person of ordinary skill in the art to make and use embodiments described herein. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of the disclosure. Thus, the disclosure is not intended to be limited to the examples described herein and shown, but is to be accorded the scope consistent with the claims.

The word "exemplary" is used herein to mean "serving as an example illustration." Any aspect or design described herein as "exemplary" is not necessarily to be construed as preferred or advantageous over other aspects or designs.

Reference will now be made in detail to aspects of the subject technology, examples of which are illustrated in the accompanying drawings, wherein like reference numerals refer to like elements throughout.

It should be understood that the specific order or hierarchy of steps in the process disclosed herein is an example of exemplary approaches. Based upon design preferences, it is understood that the specific order or hierarchy of steps in the processes can be rearranged while remaining within the scope of the disclosure. Any accompanying method claims present elements of the various steps in a sample order, and are not meant to be limited to the specific order or hierarchy presented.

The embodiments disclosed herein describe a new, clean and hygienic washing bidet. The various embodiments include one or a plurality of water inlets, a control means housing one or a plurality of control valves to control the flow of water from the water inlet(s) to one or a plurality of water tubes, one or a plurality of washing nozzles, a protective shield gate, and securing unit configured to securing the sanitary washing device to the toilet seat.

The disclosed embodiments directed to a clean and hygienic bidet washing apparatus 100 attachable to an existing toilet for cleaning the body parts of the user sitting on or near the toilet.

As described herein, a "bidet" is a toilet attachment for cleaning the body parts of the user.

As described herein, the term "water inlet" means any structure that may provide water to the bidet washing apparatus.

As described herein, a "control unit" (aka "control panel") is the housing which has "control switche(s)" thereon controlling the various functionalities of the bidet, including but not limited to, flow of water, adjusting the angle of the nozzles, and opening and closing the protective shield gate.

As described herein, "control valves" are controller parts located inside the control unit housing which control the flow of water or other fluids from the water inlet(s) to one or more "water tubes" by opening, closing or partially obstructing various passageways.

As described herein, "water tubes" are channels that connect the control valves to a "nozzle assembly," wherein, the "nozzle assembly" includes a single nozzle or a collection of nozzles including at least one "washing nozzle."

As described herein, a "nozzle" is a device designed to eject water or other fluids into the surrounding medium as a coherent controlled spray.

As described herein, the "washing nozzle" is the nozzle that can be used to wash the body parts of a user.

As described herein, the "nozzle assembly" may also have other types of nozzles such as a "self-cleaning nozzle," which is used to clean the nozzle assembly itself, a "toilet cleaning nozzle," which is used to clean the bidet and/or the toilet, and a "shield cleaning nozzle," which is used for cleaning the "protective shield gate."

As described herein, the "protective shield gate" is a structure placed at least partially in front of the nozzle assembly (e.g., between the user and the nozzle assembly) to protect the nozzle assembly from pollutants.

As described herein, the "protective shield gate" can have a "hinged" edge. The term "hinged" hem means a joint that allows the turning or pivoting of the gate, by any conventional turning or pivoting mechanism.

As described herein, the term "fluidically coupled" means a connection or a passageway which allows fluid to flow therethrough.

As described herein, the term "reservoir" means a fluid holding tank.

Accordingly, in one embodiment the disclosure provides a bidet washing apparatus attachable to a toilet bowl for cleaning one or more body parts of a user. The apparatus can include one or more water inlets configured to supply water, and a control unit, housing one or more valves fluidically connected to the one or more water inlets, including one or more control switches configured to operate the one or more valves. As such, the one or more valves can control water flow from the one or more water inlets. The apparatus can further include a nozzle assembly including at least one washing nozzle, fluidically connected to at least one of the one or more valves with one or more water tubes. The at least one washing nozzle can be positioned for directing water to the one or more body parts of the user. The apparatus can also include a protective shield gate covering at least a portion of the at least one washing nozzle, where the protective shield gate is rotatably coupled to the bidet washing apparatus.

According to various embodiments, the protective shield gate can be rotatably coupled to the apparatus along a side or top edge via a hinge, for example, in order to allow for the manual or electrical opening and closing of the protective shield gate. In this manner, the nozzle(s) are easily accessible for cleaning, removal, replacement or other adjustment while the protective shield gate is open. In an alternative embodiment, the protective shield gate can be completely removed to similarly provide access to the nozzle(s).

According to another embodiment, the water inlet(s) can be fluidically connected to one or more valves via a single-body connector without any intervening parts or joints, which results in a more robust, long-lasting, bidet washing apparatus, since leaks or other damage to the fluidic couplings are less likely to occur.

Figure 2:
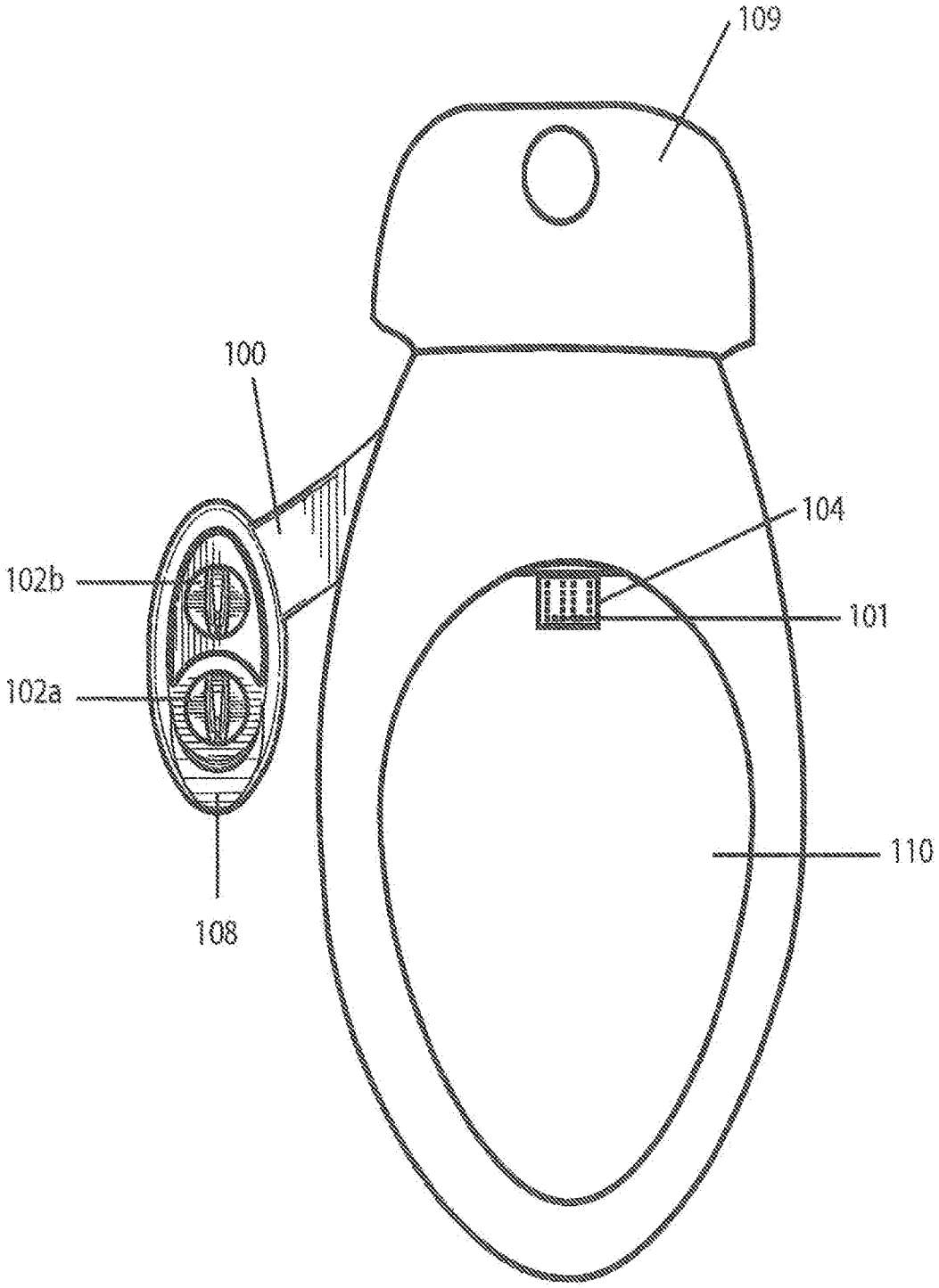
FIG. 2 illustrates an embodiment of a perspective view of a bidet washing apparatus installed on an existing toilet seat, with the seat cover down.

Referring to FIG. 1 and FIG. 2, the bidet washing apparatus 100 of the disclosure can be mounted on a toilet bowl 110 using securing mechanism 105*a* and 105*b*. Any conventional securing unit can be implemented, e.g., one or more screws. A seat 112 can pivot around and can be connected to a rear portion of the toilet bowl 110. On the rear portion of the toilet bowl 110 can be mounted a refillable toilet tank 109, in which an amount of water can be stored. In certain embodiments, the toilet tank 109 can be used as the water source for the bidet washing apparatus 100 by a fluidic connection. On the bidet washing apparatus 100 can be mounted a nozzle assembly 101, which includes at least one washing nozzle (not shown) for washing the body parts of the user sitting on or near the toilet bowl 110. The body of bidet washing apparatus can be made of any suitable material, including but not limited to, plastics, polymers, reinforced polymeric materials, wood, metal and the like, and any combination thereof.

Figure 3:
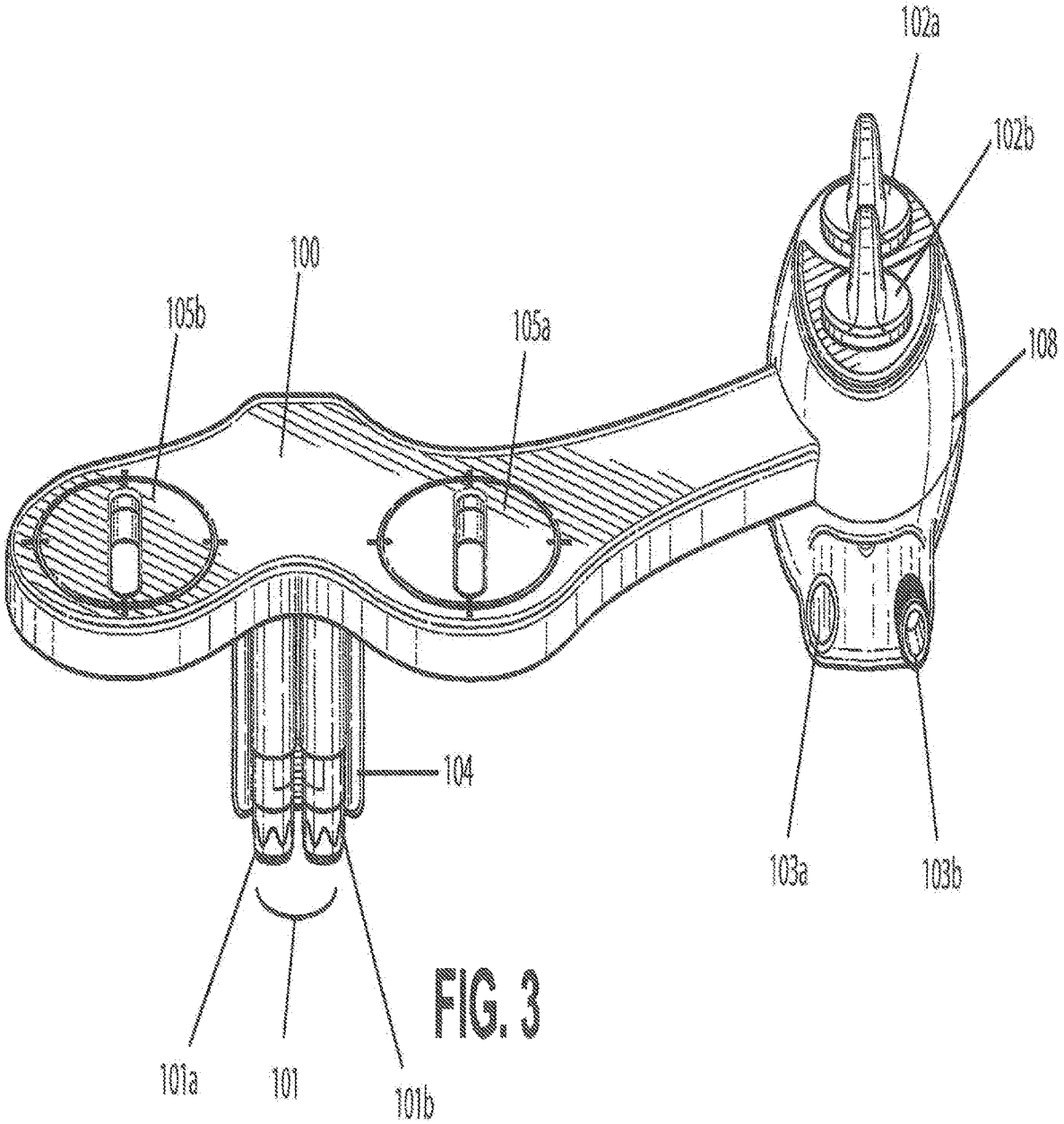
FIG. 3 illustrates an embodiment of a perspective view of an exemplary bidet washing apparatus.

FIG. 3 shows one exemplary embodiment of a bidet washing apparatus 100 with two washing nozzles 101*a* and 101*b*, respectively. However, in an installation a lesser or greater number of nozzles can be used. Each washing nozzle can spray a stream of water upwardly and inwardly, according to various embodiments.

As shown in FIG. 2 and FIG. 3, a control unit 108 can be provided for easy access for the user, and houses control switches 102*a* and 102*b* for providing operational instructions to the bidet washing apparatus 100. The depicted example shows two switches 102*a* and 102*b*; however, one of ordinary skill in the art would realize that any number of switches can be provided for performing various operations without departing from the scope of the disclosure. Some examples of operational instructions include, but are not limited to, controlling the flow of water from the water inlet, changing the angle of the washing nozzles, and opening and closing the protective shield gate (described in further detail below). The type of control switches can be selected from a group including knobs, dials, levers, and depressible buttons, or any conventional control mechanism. An installation may have all similar control switches where both control switches 102*a* and 102*b* are knobs.

Figure 9:
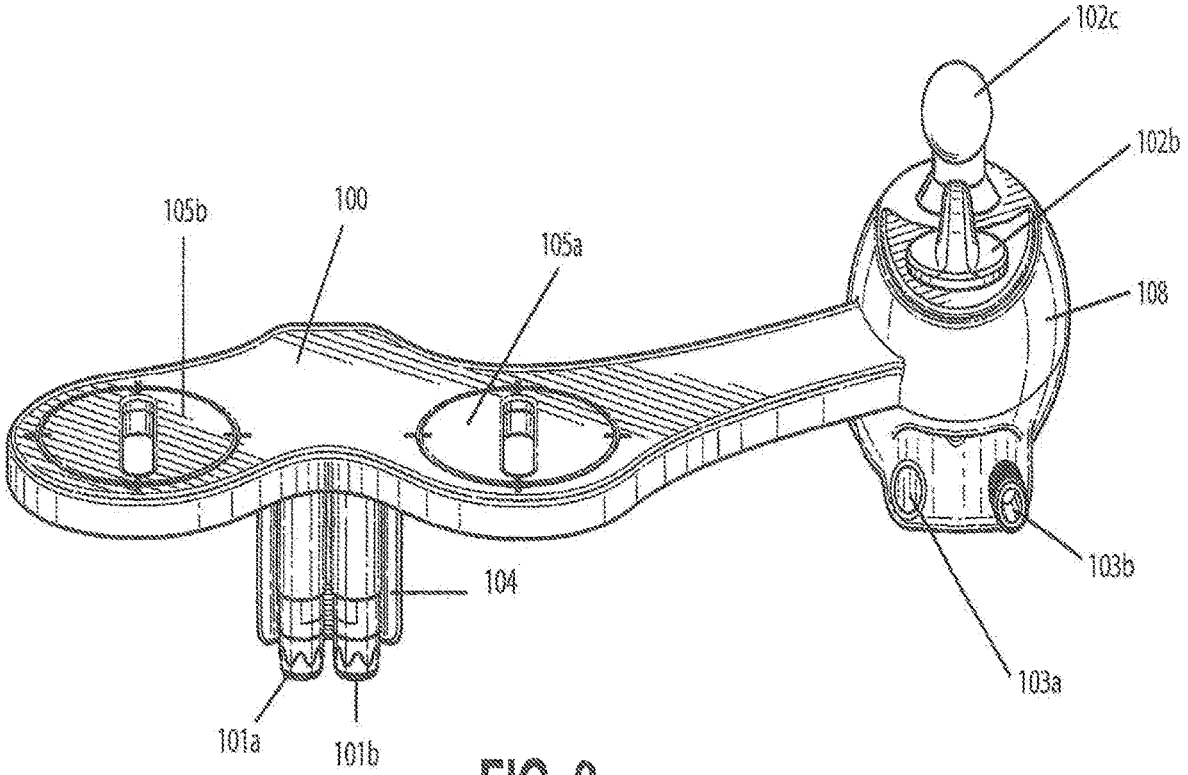
FIG. 9 illustrates an embodiment of a perspective view of an exemplary bidet washing apparatus.

On the other hand, FIG. 9 shows an embodiment of the disclosure where one of the control switches 102*b* is a knob and the other control switch 102 *c* is a lever.

Furthermore, as shown in FIG. 1 and FIG. 2, the nozzle assembly 101 can have a protective shield gate 104 substantially or partially in front of it. The position of the protective shield gate 104 is such that it can act as a shield between the user's body and/or water in the toilet bowl 110 and the nozzle assembly 101 thus protecting the nozzle assembly 101 from pollutants during use.

Certain aspects of the bidet washing apparatus will be detailed hereinafter with reference to FIGS. 3-9.

FIG. 3 shows a front perspective view of one embodiment described herein. Referring to FIG. 3, the bidet washing apparatus 100 includes the water inlets 103*a* and 103*b* to feed water into the bidet. The water inlet can be controlled by the user using the control switches 102*a* and 102*b* situated on the control unit 108. The water from the water inlets 103*a* and 103*b* can be ultimately provided to the nozzle assembly 101 via tubes (as described in greater detail with reference to FIG. 7, for example). The nozzle assembly shown in this aspect of the disclosure has two washing nozzles 101*a* and 101*b*. The protective shield gate 104 protects the nozzle assembly 101 from excrement and pollutants as described above. In this example, the protective shield gate 104 is positioned in front of the nozzle assembly 101 of the bidet such that it is between the user sitting on the toilet seat, for example, and the nozzle assembly. Hence, when the user is using the toilet, the nozzles are shielded behind the shield gate 104 and do not become polluted.

Figure 5:
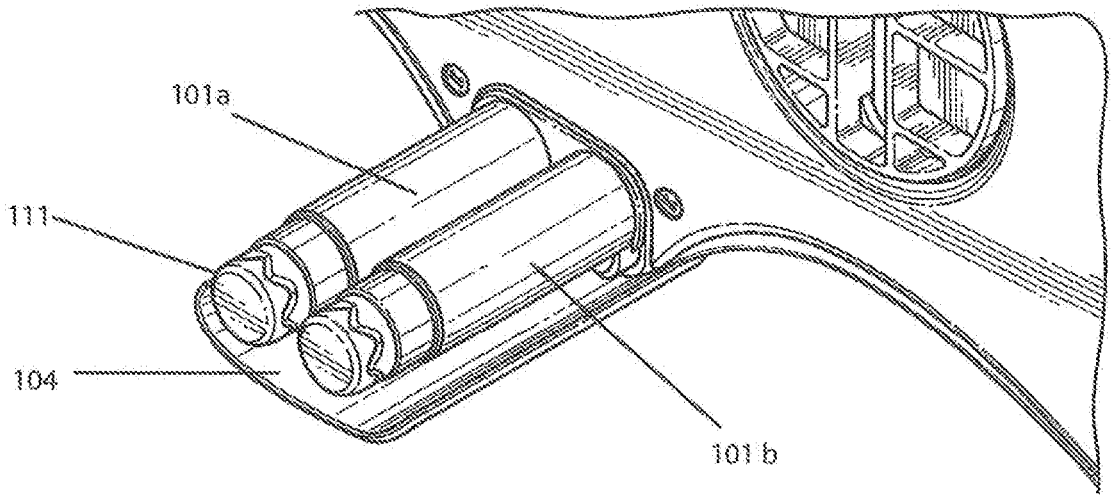
FIG. 5 illustrates an embodiment of a fragmentary view of an exemplary bidet washing apparatus illustrating the gate shield protecting the nozzle assembly in a closed position.
Figure 6:
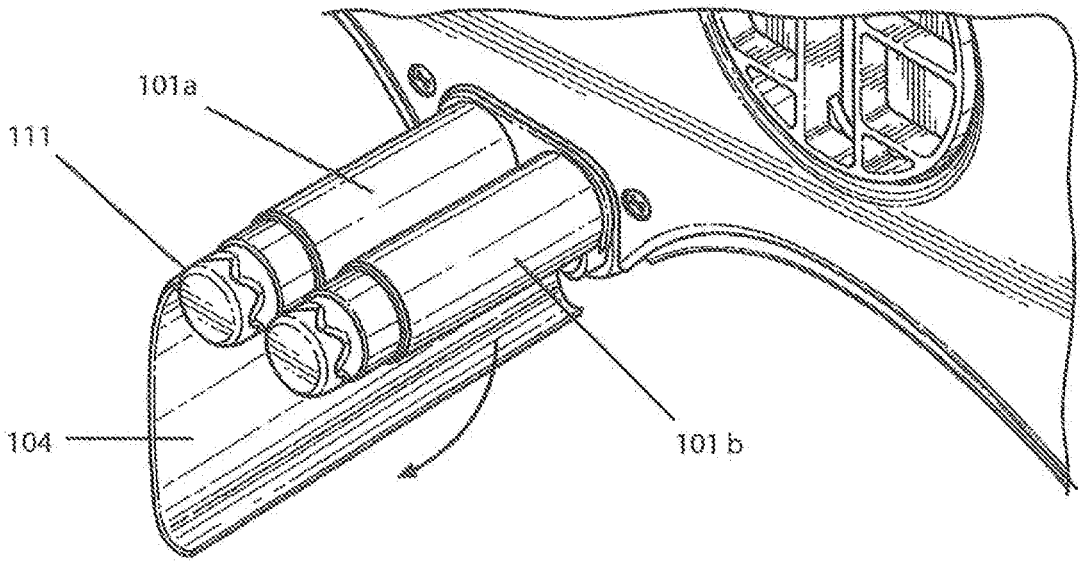
FIG. 6 illustrates an embodiment of a fragmentary view of an exemplary bidet washing apparatus illustrating the shield gate protecting the nozzle assembly in an open position.

Referring to FIGS. 5-6, the protective shield gate 104 can be movable along a hinged edge 111 to provide for further hygiene. The protecting shield gate 104 rotates and thus can be manually, for example, opened (FIG. 6) and closed (FIG. 5), after using the toilet to clean any minute left over pollutants on the outer covering of the nozzle assembly to ensure complete cleanliness. In the embodiment, the user can open and close the gate manually and, thus, the gate can stay in the opened or closed position that the user places the gate. In certain embodiments, the gate can be opened and closed by an electrical signal using a control switch located on the control unit 108, which can allow the gate to remain open until the user closes the gate via the control switch, so the user can clean the nozzle. In other embodiments, the hinged edge 111 is on the top of the protective shield gate 104, and not on the side edge as shown in the illustrative FIGS. 5-6. In yet other embodiments, the user may be able to completely remove the protective shield gate 104 for cleaning the nozzle(s), and reattach it after cleaning. Of course, one of ordinary skill in the art would understand that the hinged edge could comprise any rotatable joint mechanism that allows for the rotation of the gate 104 to provide efficient access to the nozzle(s). If the gate 104 is completely removable, a grooved and slidable mechanism can be employed so that the gate 104 can slide in and out to be attached and removed. Of course, other mechanisms can be utilized for removably attaching the gate 104, e.g., a magnet or a snap structure.

In certain embodiments, the protective shield gate 104 has a flap portion perpendicular to the shield gate 104 such that it covers the bottom of the nozzle assembly 101. Additionally, the flap can have a spring mechanism such that it is pushed out and aligns with the shield gate 104 by the force of the water stream when water flows out of the nozzle assembly 101. When the water flow stops, the flap can spring back into its original position perpendicular to the shield gate 101.

The protective shield gate 104 of the disclosure can be made from a material selected from plastic, metal, material having anti-microbial properties, and material with increased pollutant repellant properties.

In certain embodiments, the angle of the washing nozzles can be adjusted using control switche(s) located on the control unit 108. Thus, when a user wants to clean certain body parts, water can be sprayed on a desired body part by adjusting the angle of the washing nozzle(s). As shown in FIG. 3, the height of the protective shield gate is such that it allows for an uninterrupted spray of water from the nozzle assembly 101, since the nozzle assembly 101 can extend beyond the bottom edge of the gate 104.

Figure 4:
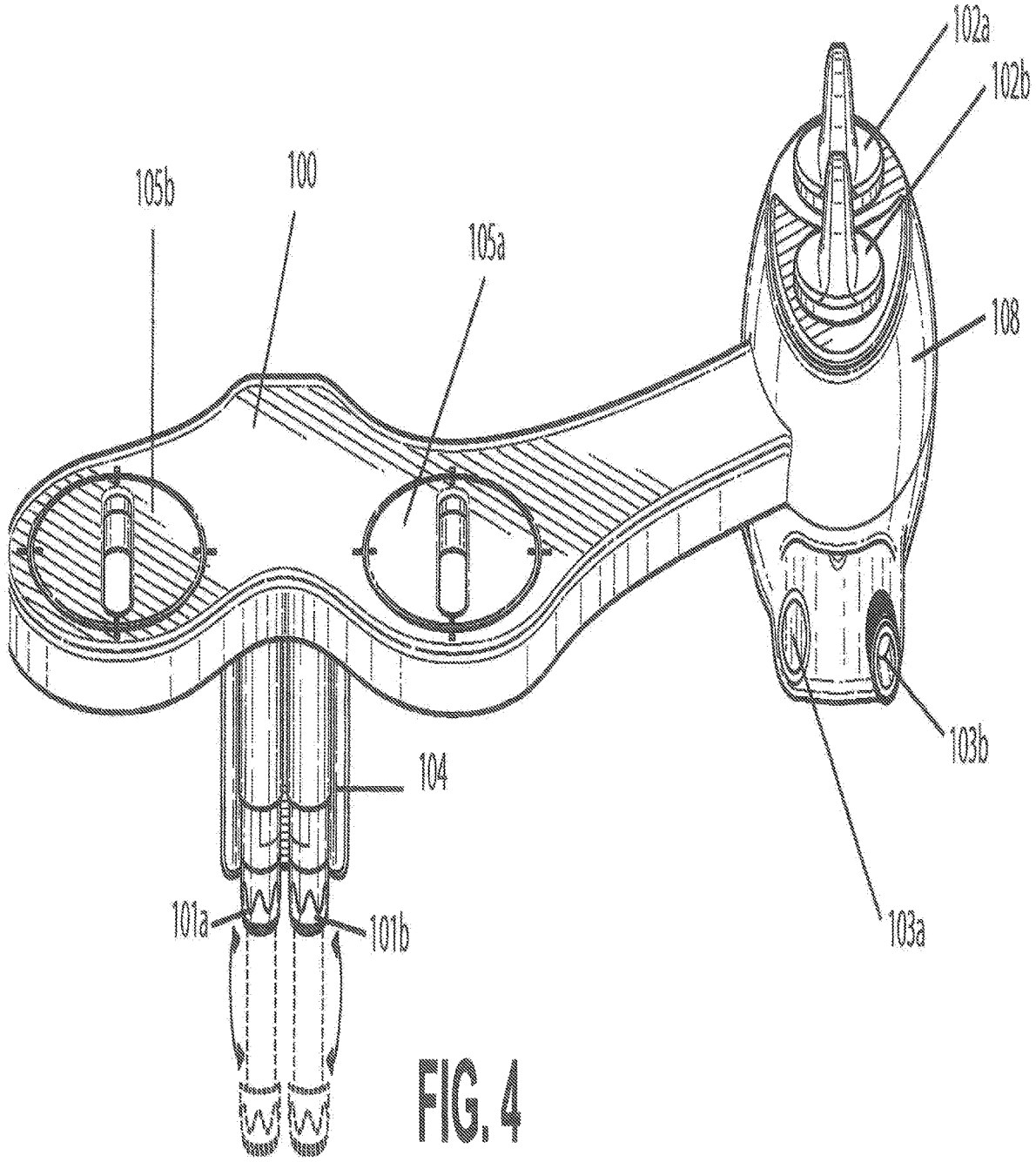
FIG. 4 illustrates an embodiment of a perspective view of an exemplary bidet washing apparatus, with the dotted lines showing the nozzles extended outwards.

FIG. 4 shows another embodiment wherein the height the protective shield gate is equal to or greater than that of the washing nozzles 101*a* and 101*b*. Here, the washing nozzles 101*a* and 101*b* are housed within an outer covering including a spring mechanism for pushing the washing nozzles out when water flows through the washing nozzles such that the water flow is not interrupted by the protective shield gate 104. Each washing nozzle includes an outer covering and an inner nozzle operated slidably back and forth with hydraulic pressure of the supplied washing water in accordance with an instruction from the control unit 108. During use of the washing nozzles, the nozzles are extended from their outer covering below the length of the shield gate by the hydraulic force of the washing water and water is sprayed on the user for cleaning purposes. After use, when the water flow is stopped, the nozzles are retracted in their outer covering which is hidden behind the shield gate. In certain other embodiments, the user may control the movement of the washing nozzle by using the control unit 108, instead of the hydraulic pressure. When an instruction of a washing operation is given by the control unit 108, a washing nozzle driving unit is activated to advance the nozzle. The washing nozzle angle can also be adjusted by an instruction given by the control unit 108 to position the nozzle for cleaning. Thus, the washing nozzle can reach the user's desired washing position by the combined advancement of the nozzle and/or the angular positioning.

According to the embodiment, the nozzle assembly 101 includes at least one washing nozzle. In yet another embodiment, the bidet washing apparatus 100 further includes a self-cleaning nozzle for cleaning the nozzle assembly itself. The self-cleaning nozzle can be positioned to spray water onto the nozzle assembly 101 and/or washing nozzle(s) before and/or after usage for additional hygiene. The self-cleaning nozzle can be adapted to be controlled by the control unit 108, and thus provides an additional hygiene level.

Another embodiment includes a toilet cleaning nozzle for cleaning the toilet and the bidet before and after use of the toilet. The toilet cleaning nozzle can be positioned to spray water on the toilet bowl 110 and/or the bidet washing apparatus 100, and can be controlled by the control unit to provide additional hygiene. Yet, another embodiment includes a shield cleaning nozzle for cleaning the protective shield gate 104. The shield cleaning nozzle can be similarly controlled by the control unit 108. Additionally, the shield cleaning nozzle can be positioned to clean the shield gate 104 in an open and/or closed position.

Any or all of the washing nozzles can be connected to the nozzle assembly 101 via a ball joint, for example, which could allow the user to manually swivel a washing nozzle around 360 degrees, in order to direct the spray of water in a desired and precise direction. Of course, other types of joints and connectors could be implemented in order to allow for the manual swivel or direction correction, as desired by the user to spray water to a desired body part, for example.

Moreover, according to an exemplary embodiment, one or more of the washing nozzle(s) 101*a* and 101*b* can be connected to the nozzle assembly 101 by a mechanism allowing for the easy removal of the nozzle(s) 101*a* and 101*b*. For example, the washing nozzle(s) 101*a* and 101*b* can slide into place via a grooved portion of the nozzle assembly 101, or could otherwise snap into place. Any conventional mechanism of removably attaching the nozzle(s) 101*a* and 101*b* can be implemented so that the user can swap the nozzle(s) 101*a* and 101*b* with other nozzles or increase or reduce the number of washing nozzle(s) 101*a* and 101*b* connected to the nozzle assembly 101.

Figure 7:
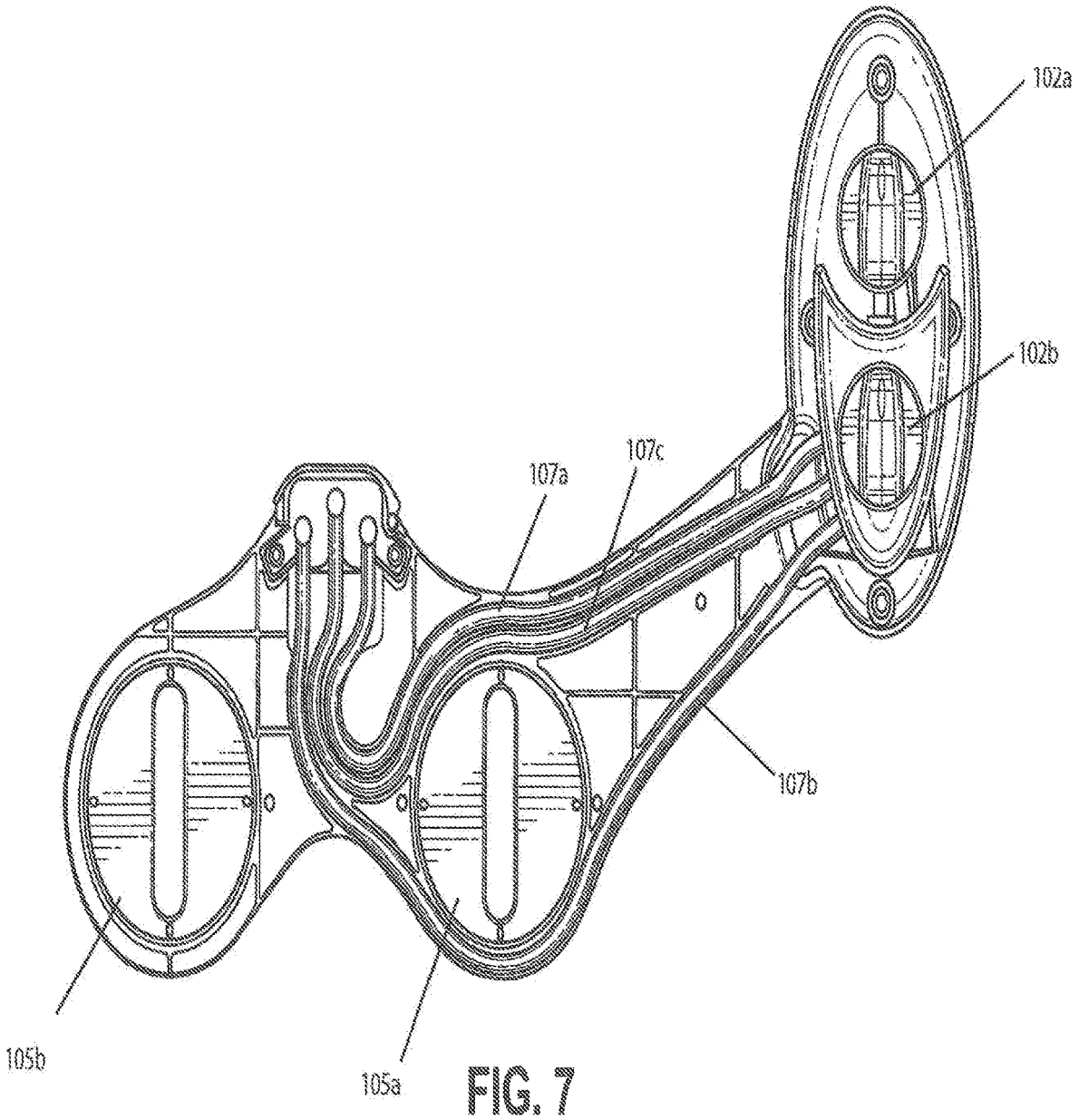
FIG. 7 illustrates an embodiment of a top plan view of the exemplary embodiment.
Figure 8:
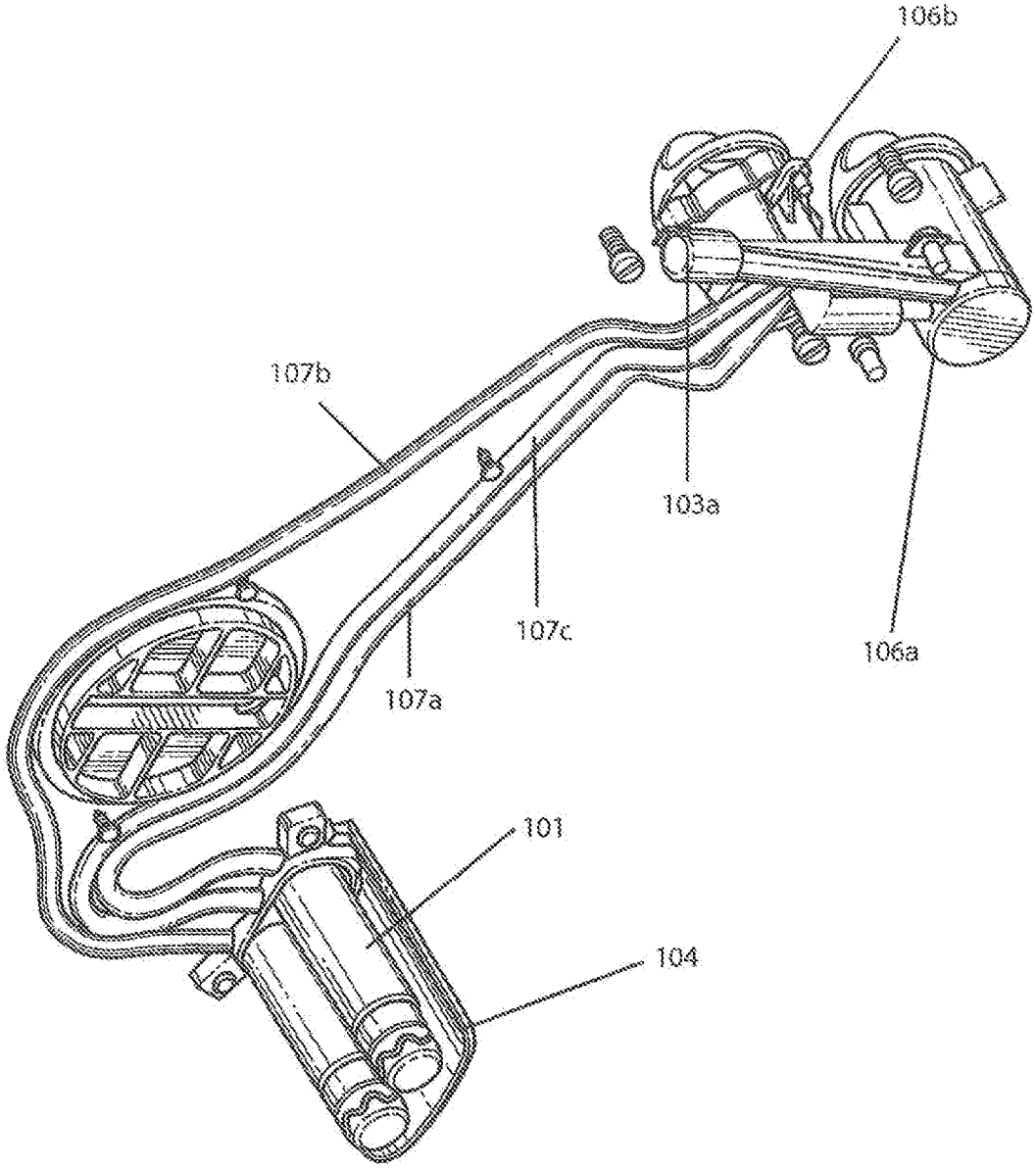
FIG. 8 illustrates an embodiment of a bottom plan view of a perspective view of a bidet washing apparatus.

An exemplary water supply system to the nozzle assembly 101 will be detailed hereinafter with reference to FIGS. 7-8. The control unit 108 can house the control valves 106*a* and 106*b* (as shown in FIG. 8), to control the flow of water to the water tubes and has the control switches 102*a* and 102*b*, for giving instructions to the control valves. Two control valves and control switches are depicted for exemplary purposes, but it should be understood that any number of control valves and corresponding switches can be employed.

The control valves 106*a* and 106*b* can be situated at the entrance to the water tubes 107*a*-107 *c* in this example. The control valves 106*a* and 106*b* are designed to open, close or partially obstruct the water inlet 103 opening into the water tubes 107*a*, 107*b* and 107 *c*, such that the volume of the water flowing through the any tube at any given time can be easily controlled by the user by giving simple instructions thorough the control switches. The water tubes 107*a*-107 *c* connect the control valves 106*a*-106*b* at one end to the nozzle assembly 101 at the other end. Thus, the control valves 106*a*-106*b* can effectively control the volume of water flowing to the nozzle assembly 101. In the embodiment, one water tube 107*b* passes through the back of the bidet washing apparatus 100, and two water tubes 107*a* and 107 *c* pass through the front of the bidet washing apparatus 100. However, it is to be noted that in an embodiment, more than one water tube could pass through the back of the bidet washing apparatus 100, and the number of water tubes passing through the front of the bidet washing apparatus 100 could be more or less than two.

According to an embodiment, the bidet washing apparatus 100 can include a vacuum breaker (not depicted), which can be situated at various locations within the bidet washing apparatus 100. The vacuum breaker can be located anywhere between the water supply (e.g., the water tank supplying water to the toilet bowl) and the washing nozzle(s)(e.g., 101*a*-101*b*) output. The vacuum breaker can be intended to halt the flow of water that is not expelled by the washing nozzle(s) back into the water supply. According to one exemplary embodiment, the vacuum breaker(s) can be housed within the control unit 108, located between control valves 106*a*-106*b* and the nozzle assembly 101; however, one of ordinary skill in the art would realize that various locations of one or more vacuum breakers can be implemented within the scope of this disclosure to perform the desired function.

Figure 10:
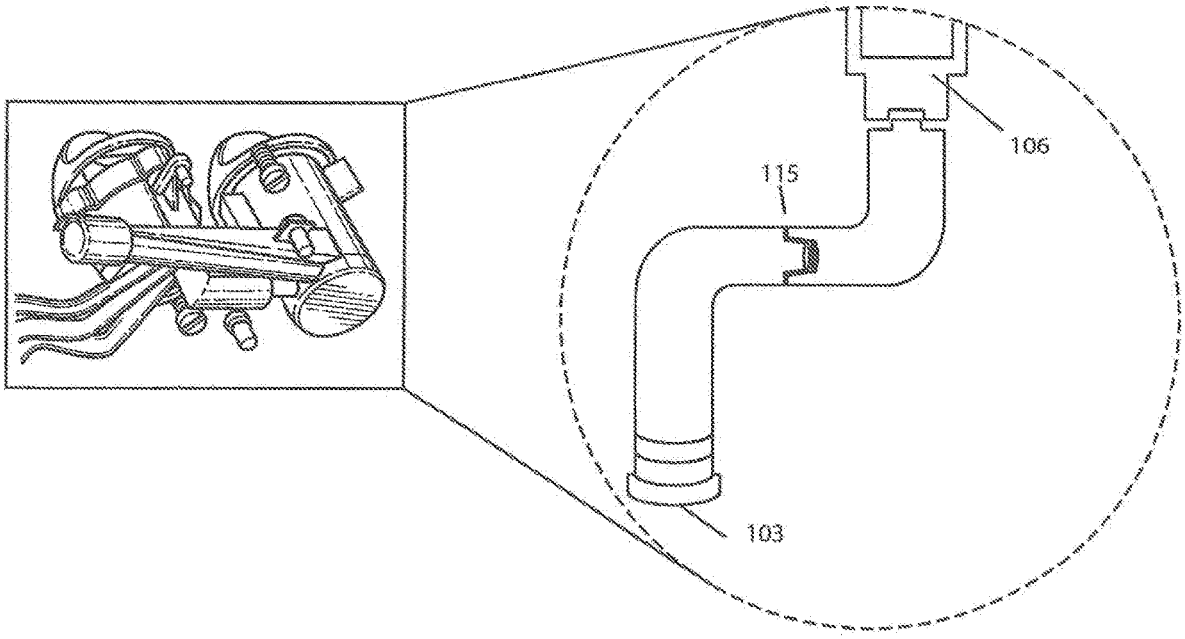
FIG. 10 illustrates an embodiment of a schematic showing a single connection between a water inlet and a control valve inside a control unit.

In one exemplary embodiment, each water inlet 103*a*-103*b* is connected to a control valves 106*a*-106*b* by a single, non-jointed, connection 115 (see FIG. 10) thereby removing any intervening parts and extra connections, which can considerably increase the durability and lifetime of the bidet system. Of course, multiple water inlets 103*a*-103*b* could be connected to a single control valve; however, each connection between the water inlets 103*a*-103*b* and the single control valve can be a single-body structure, according to one embodiment.

In an embodiment, the washing nozzle can be replaced with a nozzle that is configured to hold materials such as soap, disinfectant or any cleaning or medicinal substance that can be expelled along with water as it flows through the nozzle. For example, such materials could be in a solid, semi-solid or liquid form, which dissolves at a predetermined and desired rate, as the water flows through the nozzle and is carried out of the nozzle by the spraying water.

In another embodiment, the bidet washing apparatus can contain one or more reservoir dispensers or chambers, which can be configured to hold materials such as soap, disinfectant or any cleaning or medicinal substance that can be expelled along with water through one or more water tubes to the nozzle assembly and can be carried out of one or more nozzles by the spraying water. As before, the above-mentioned materials are provided merely for exemplary purposes and are not intended to limit the disclosure in any way. Other known substances and/or materials could be held and/or stored in a nozzle or reservoir dispenser in order to be expelled with water through the nozzle.

In another embodiment, the bidet washing apparatus may include a universal port adapter, which conveniently allows various bathroom accessories, e.g. toilet paper, tissue box holder, fragrances, etc. to be reversibly attached to the bidet washing apparatus. In various embodiments, the universal port adapter can be made of any suitable materials including plastics and the like, and can be of any suitable size appropriate to support the bathroom accessories.

Thus, in one embodiment the disclosure provides a universal port for a bidet washing apparatus, which includes a rail unit having a proximal end and a distal end, wherein the rail unit is attachable to the bidet washing apparatus; and a slider unit having a proximal end and a distal end, wherein the slider unit is reversibly, slidably attachable to the rail unit.

In one aspect, the disclosure provides a universal port for a bidet washing apparatus, which further includes one or more bathroom accessory units attachable to the slider unit.

In another aspect, the disclosure provides a universal port for a bidet washing apparatus, wherein the one or more bathroom accessory units include a tissue box holder, a toilet paper roll holder, a fragrance bottle holder, or an air freshener holder.

In another aspect, the disclosure provides a universal port for a bidet washing apparatus, which further includes one or more holes rail unit and one or more screws for securing the rail unit to the bidet washing apparatus.

In another aspect, the disclosure provides a universal port for a bidet washing apparatus, which further includes one or more holes in the distal end of the rail unit and one or more snaps in the proximal end of the slider unit.

In another aspect, the disclosure provides a universal port for a bidet washing apparatus, wherein the one or more holes in the distal end of the rail unit receives the one or more snaps in the proximal end of the slider unit.

In another aspect, the disclosure provides a universal port for a bidet washing apparatus, wherein the rail unit is attachable to a bottom side of the bidet washing apparatus.

In another aspect, the disclosure provides a universal port for a bidet washing apparatus, wherein the rail unit is a solid T-bar shaped rail unit; and the slider unit is a complementary hollow T-bar shaped slider unit.

In another embodiment, disclosure provides a universal port for a bidet washing apparatus, which includes a slider unit having a proximal end and a distal end, wherein the slider unit is attachable to the bidet washing apparatus; and a rail unit having a proximal end and a distal end, wherein the rail unit is reversibly, slidably attachable to the slider unit.

In one aspect, the disclosure provides a universal port for a bidet washing apparatus, which further includes one or more bathroom accessory units attachable to the rail unit.

In another aspect, the disclosure provides a universal port for a bidet washing apparatus, wherein the one or more bathroom accessory units include a tissue box holder, a toilet paper roll holder, a fragrance bottle holder, or an air freshener holder.

In another aspect, the disclosure provides a universal port for a bidet washing apparatus, which further includes one or more holes in the slider unit and one or more screws for securing the slider unit to the bidet washing apparatus.

In another aspect, the disclosure provides a universal port for a bidet washing apparatus, which further includes one or more holes in the distal end of the rail unit and one or more snaps in the proximal end of the slider unit.

In another aspect, the disclosure provides a universal port for a bidet washing apparatus, wherein the one or more holes in the distal end of the rail unit receives the one or more snaps in the proximal end of the slider unit.

In another aspect, the disclosure provides a universal port for a bidet washing apparatus, the slider unit is attachable to a bottom side of the bidet washing apparatus.

In another aspect, the disclosure provides a universal port for a bidet washing apparatus, wherein the slider unit is a hollow T-bar shaped slider unit; and the rail unit is a complementary solid T-bar shaped rail unit.

In another embodiment the disclosure provides a method of attaching a bathroom accessory unit to a bidet washing apparatus, which includes attaching one or more bathroom accessory units to the bidet washing apparatus using a universal port, wherein the universal port includes a rail unit having a proximal end and a distal end, wherein the rail unit is attachable to the bidet washing apparatus; and a slider unit having a proximal end and a distal end, wherein the slider unit is reversibly, slidably attachable to the rail unit, wherein the one or more bathroom accessory units is attached to the slider unit.

In yet another embodiment the disclosure provides a method of attaching a bathroom accessory unit to a bidet washing apparatus, which includes attaching one or more bathroom accessory units to the bidet washing apparatus using a universal port, wherein the universal port includes a slider unit having a proximal end and a distal end, wherein the slider unit is attachable to the bidet washing apparatus; and a rail unit having a proximal end and a distal end, wherein the rail unit is reversibly, slidably attachable to the slider unit, wherein the one or more bathroom accessory units is attached to the rail unit.

In another aspect, the disclosure provides a method of attaching a bathroom accessory unit to a bidet washing apparatus, wherein the one or more bathroom accessory units include a tissue box holder, a toilet paper roll holder, a fragrance bottle holder, or an air freshener holder.

Figure 11:
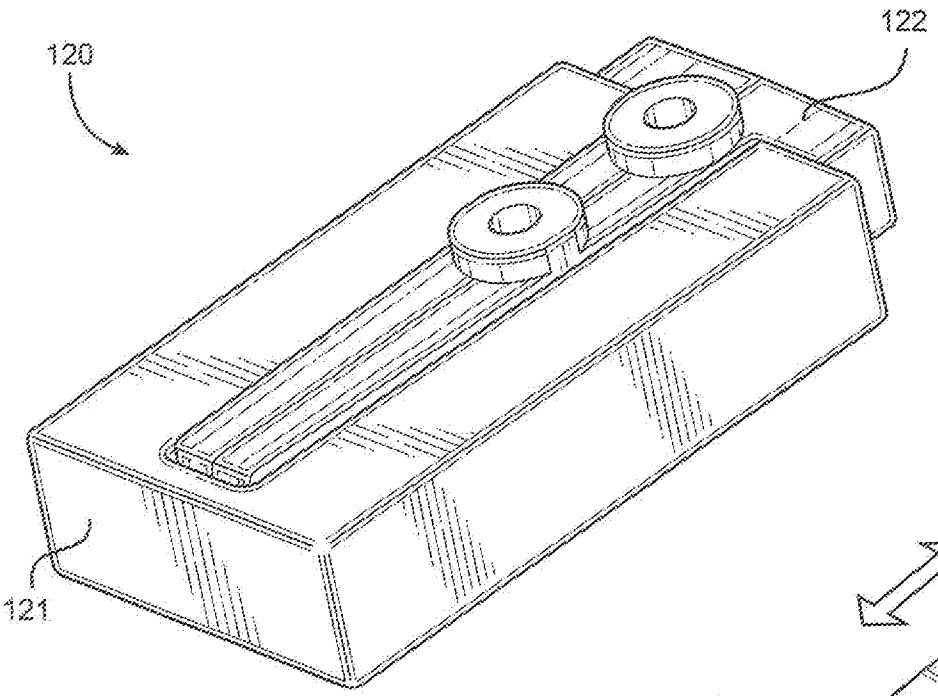
FIG. 11 illustrates an embodiment of a perspective top side view of a universal port, having a slider and rail mechanism slid together, for attachment to a bidet washing apparatus.

FIG. 11 illustrates an embodiment of a perspective top side view of a universal port adapter 120, having a slider unit 121 enclosing a rail unit 122, which can reversibly slide together. In various embodiments, either the slider unit 121 or the rail unit 122 can be used to directly attach the universal port adapter 120 to a bidet washing apparatus (not shown).

Figure 12:
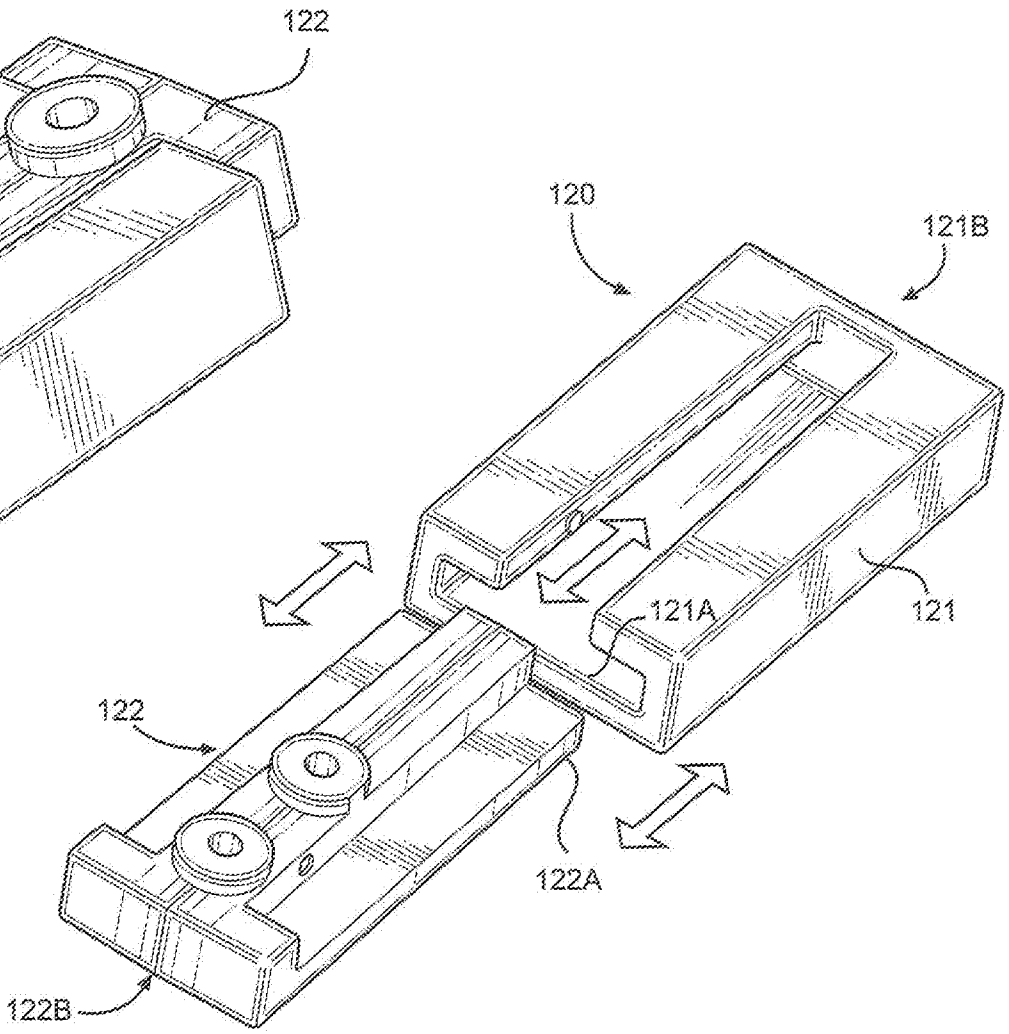
FIG. 12 illustrates an embodiment of a perspective top side view of a universal port, having a slider and rail mechanism slid apart, for attachment to a bidet washing apparatus.

FIG. 12 illustrates an embodiment of a perspective top side view of the universal port adapter 120, having a slider 121 unit and a rail unit 122, which can reversibly slide together and apart.

In embodiments, the slider unit 121 is a complementary hollow T-bar shaped slider unit 121 having an open proximal end 121*a* and a closed distal end 121*b*, wherein the complementary hollow T-bar shaped slider unit 121 is reversibly, slidably attachable to the rail unit 122. In embodiments, the rail unit 122 is a solid T-bar shaped rail unit 122 having an open proximal end 122*a* and a closed distal end 122*b*, wherein the solid T-bar shaped rail unit 122 is reversibly, slidably attachable to the complementary hollow T-bar shaped slider unit 121.

Figure 13:
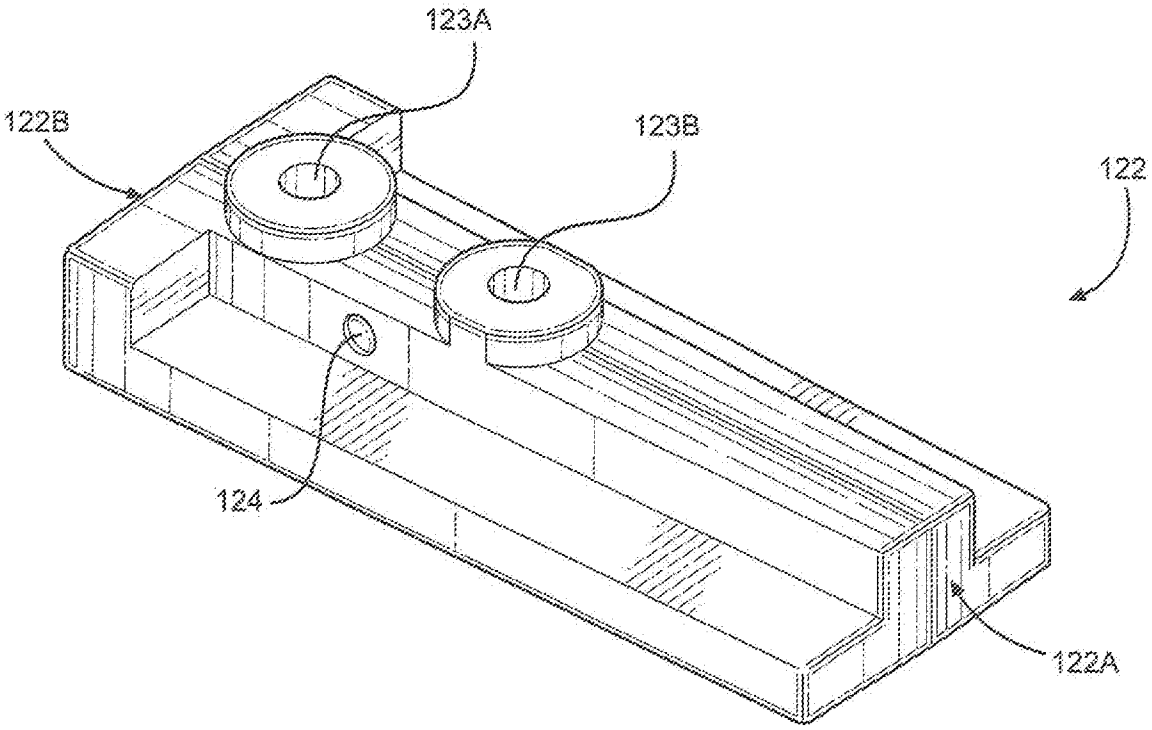
FIG. 13 illustrates an embodiment of a perspective top side view of the rail of a universal port.

FIG. 13 illustrates an embodiment of a perspective top side view of the solid T-bar shaped rail unit 122 of a universal port adapter. In embodiments, the solid T-bar shaped rail unit 122 has an open proximal end 122*a* and a closed distal end 122*b*. Also shown in this figure are two screw holes 123*a* and 123*b*, for securing the solid T-bar shaped rail unit 122 to a bidet washing apparatus (not shown) with screws (not shown). Also shown are one or more holes 124 in the distal end of the solid T-bar shaped rail unit 122*b*, which can be used to secure to one or more snaps in the proximal end of the complementary hollow T-bar shaped slider unit (not shown).

Figure 14B:
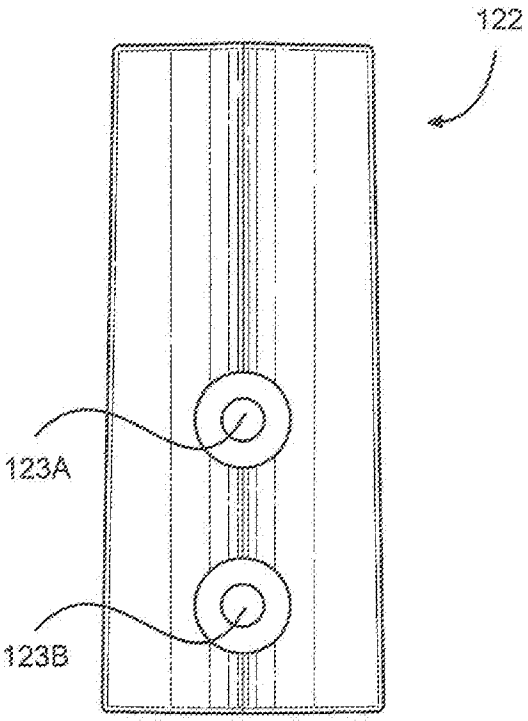
FIG. 14B illustrates an embodiment of a perspective bottom view of the rail of a universal port.
Figure 14A:
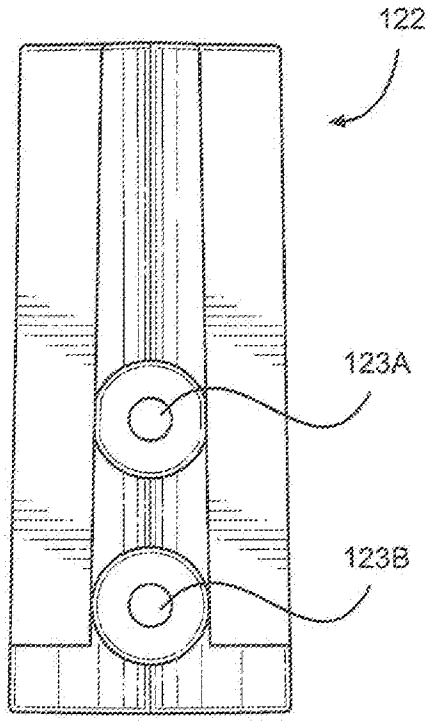
FIG. 14A illustrates an embodiment of a perspective top view of the rail of a universal port.

FIG. 14A illustrates an embodiment of a perspective top view of the rail unit 122, i.e. the solid T-bar shaped rail unit 122, of the universal port adapter; and FIG. 14B illustrates an embodiment of a perspective bottom view of the rail unit 122, i.e. the solid T-bar shaped rail unit 122, of the universal port adapter.

Figure 15:
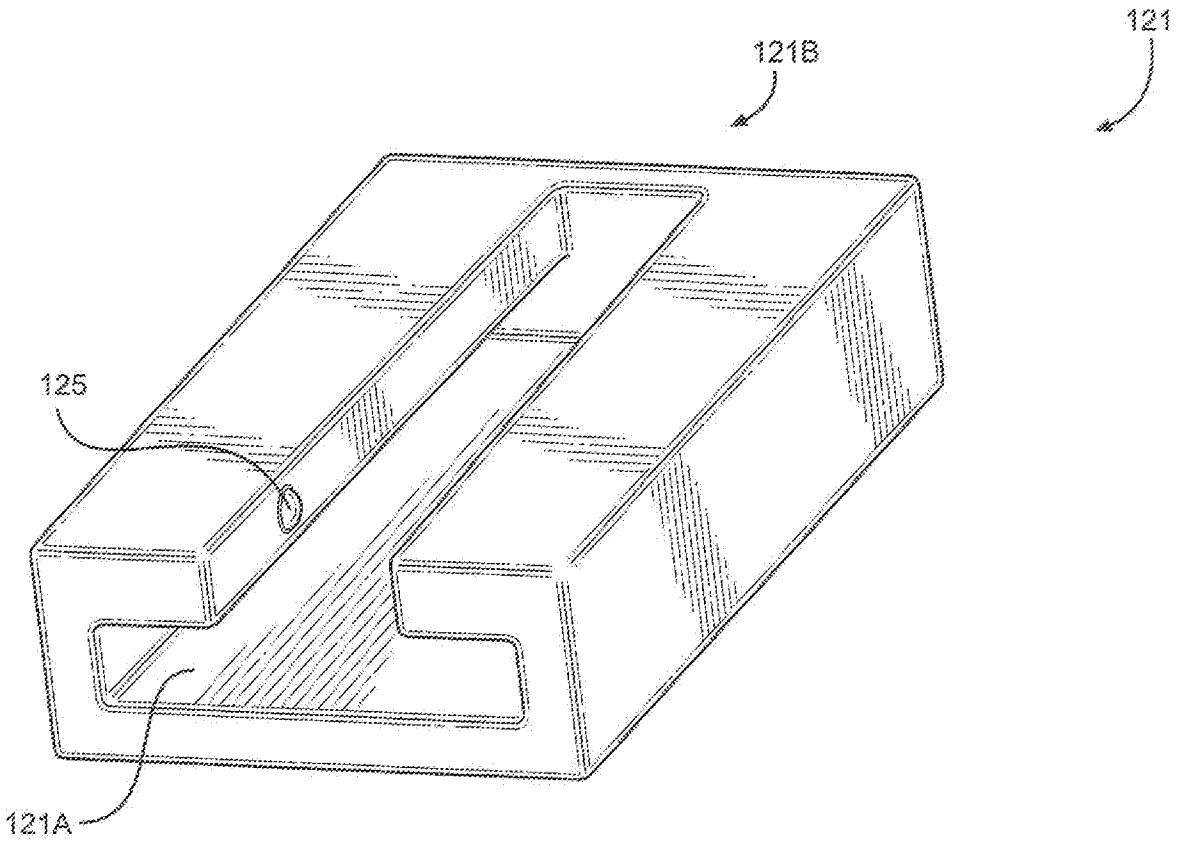
FIG. 15 illustrates an embodiment of a perspective top side view of the slider of a universal port.

FIG. 15 illustrates an embodiment of a perspective top side view of the slider unit 121, i.e. the complementary hollow T-bar shaped slider unit 121, having an open proximal end 121*a* and a closed distal end 121*b*. Also shown am one or more snaps 125 in the proximal end of the complementary hollow T-bar shaped slider unit 121*a*, which can be used to secure to the one or more holes 124 in the distal end of the complementary hollow T-bar shaped slider unit 121*b* (see, FIG. 13).

Figure 16B:
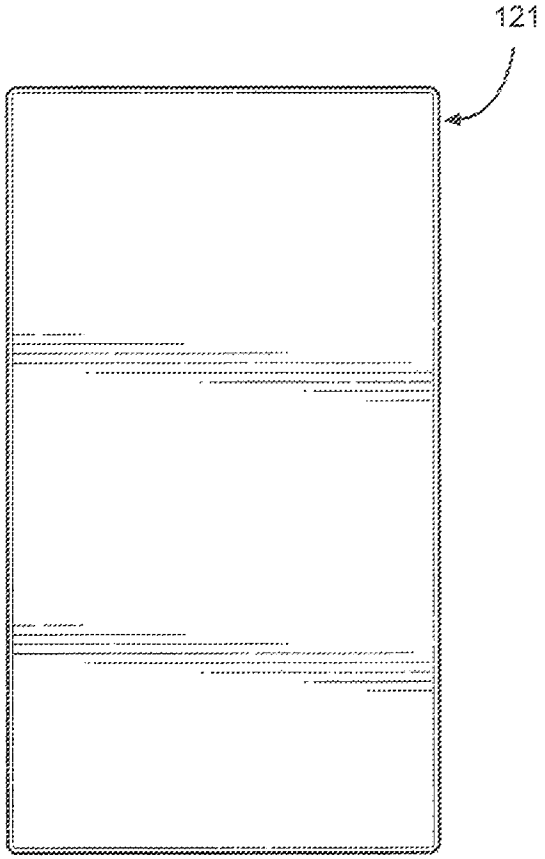
FIG. 16B illustrates an embodiment of a perspective bottom view of the slider of a universal port.
Figure 16A:
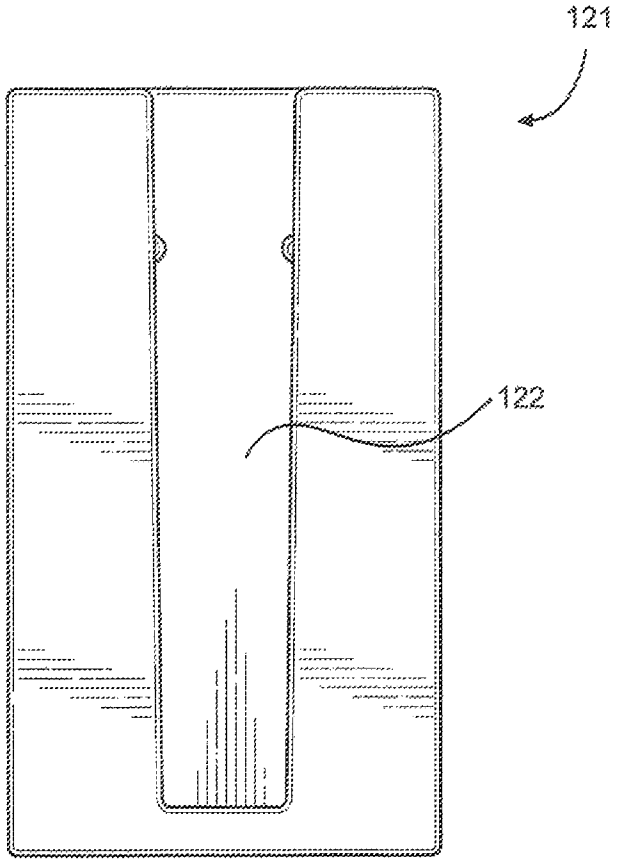
FIG. 16A illustrates an embodiment of a perspective top view of the slider of a universal port.

FIG. 16A illustrates an embodiment of a perspective top view of the slider unit 121, i.e. the complementary hollow T-bar shaped slider unit 121 of the universal port adapter; and FIG. 16B illustrates an embodiment of a perspective bottom view of the slider unit 121, i.e. the complementary hollow T-bar shaped slider unit 121 of the universal port adapter. Also shown is the rail unit 122, i.e. the solid T-bar shaped rail unit 122, of the universal port adapter.

Figure 17:
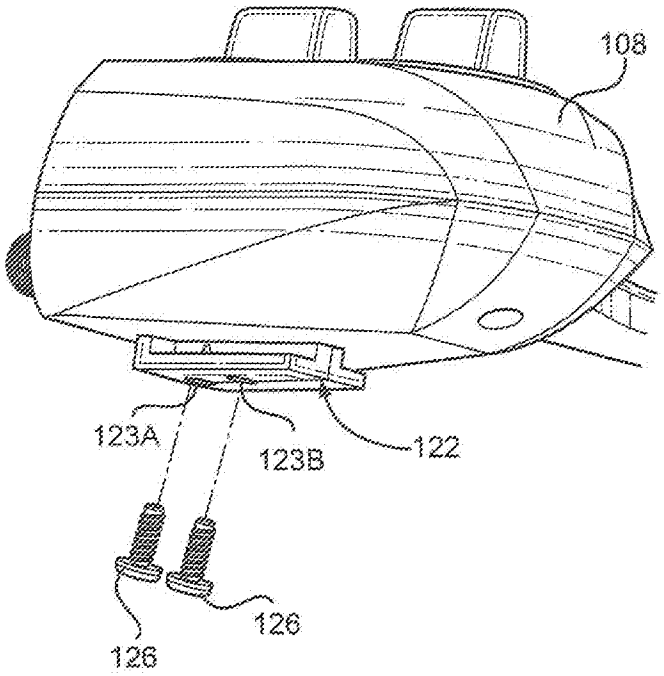
FIG. 17 illustrates an embodiment of a perspective bottom view of the rail connected to the bottom of the control unit of the bidet washing apparatus.

FIG. 17 illustrates an embodiment of a perspective bottom view of the solid T-bar shaped rail unit 122 connected to the bottom (underside) of the control unit 108 of the bidet washing apparatus. Also shown is the rail unit 122, i.e. the solid T-bar shaped rail unit 122, of the universal port adapter, which can be connected to the control unit through the use of screws 126 through screw holes 123*a* and 123*b*.

Figure 18:
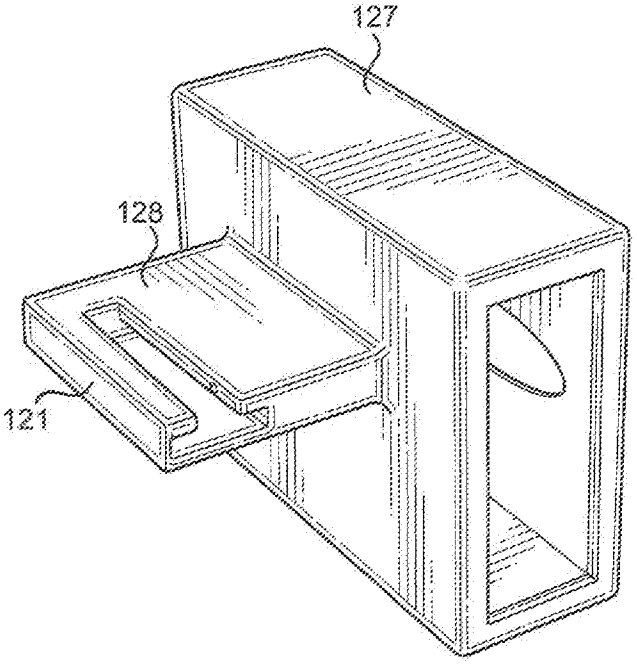
FIG. 18 illustrates an embodiment of a perspective view of the slider unit connected to a; tissue box holder.

FIG. 18 illustrates an embodiment of a perspective view of the slider unit connected to a tissue box holder for holding tissues or a box of tissues. As shown in this figure, the slider unit is a complementary hollow T-bar shaped slider unit 121, which can be connected to a bathroom accessory unit such as a tissue box holder 127 via an extended side 128 of the unit and/or the tissue box holder. In some embodiments, the tissue box holder is reversibly attachable to the unit; and in other embodiments, the tissue box holder is permanently attachable to the unit so that it can be used as a single unit.

Figure 19:
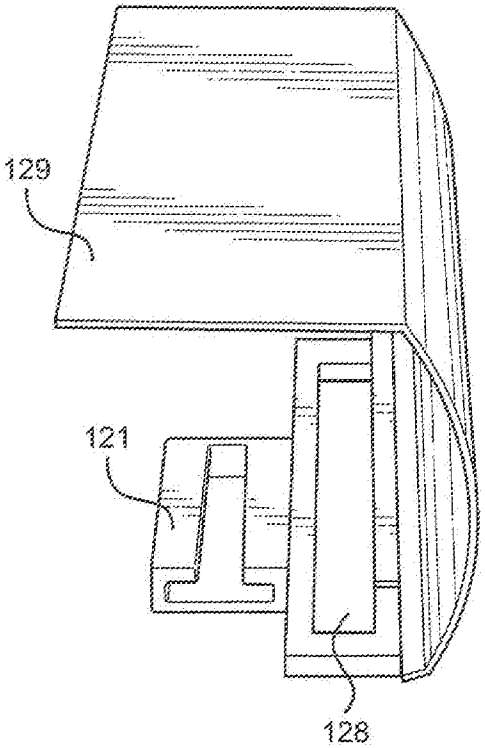
FIG. 19 illustrates an embodiment of a perspective view of the slider unit connected to a cover for protection of the control unit of the bidet washing apparatus.

FIG. 19 illustrates an embodiment of a perspective view of the slider unit connected to a bathroom accessory unit such as a cover for protection of the control unit of the bidet washing apparatus. As shown in this figure, the slider unit can be a complimentary hollow T-bar shaped slider unit 121, which can be connected to a bathroom accessory unit such as a cover 129 for the control unit 108 of a bidet washing apparatus via an extended side 128 of the unit and/or the cover. In some embodiments, the cover is reversibly attachable to the unit; and in other embodiments, the cover is permanently attachable to the unit so that it can be used as a single unit.

Figure 20:
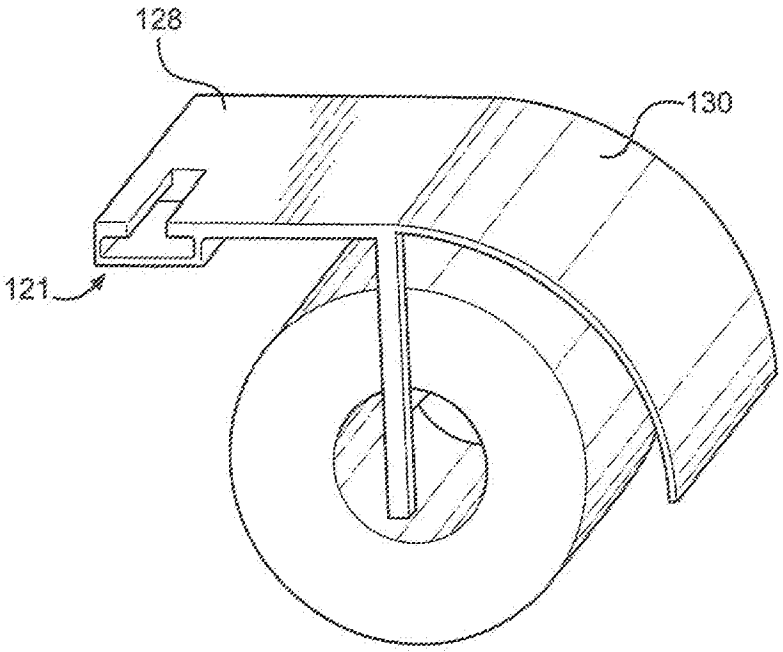
FIG. 20 illustrates an embodiment of a perspective view of the slider unit connected to a toilet paper holder for convenience of the user.

FIG. 20 illustrates an embodiment of a perspective view of the slider unit connected to a toilet paper holder for convenience of the user. As shown in this figure, the slider unit is a complementary hollow T-bar shaped slider unit 121, which can be connected to a bathroom accessory unit such as a toilet paper holder 130 via an extended side 128 of the unit and/or the holder. In some embodiments, the holder is reversibly attachable to the unit; and in other embodiments, the holder is permanently attachable to the unit so that it can be used as a single unit.

Figure 21:
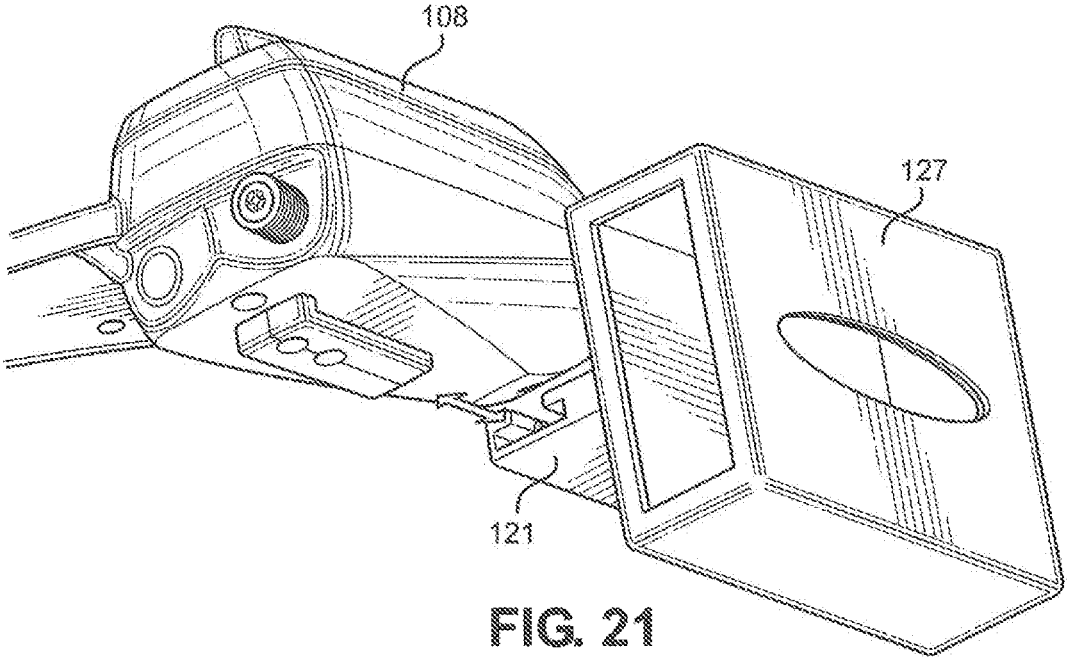
FIG. 21 illustrates an embodiment of a perspective view of the slider unit and tissue box holder reversibly attaching to the rail connected to the underside of the control unit of the bidet.

FIG. 21 illustrates an embodiment of a perspective view of the slider unit and tissue box holder reversibly attaching to the rail connected to the underside of the control unit of the bidet. As shown in this figure, the slider unit is a complementary hollow T-bar shaped slider unit 121, which can be connected to a bathroom accessory unit such as a tissue box holder 127, and be reversibly attachable to the rail, i.e. the solid T-bar shaped rail unit 122.

Figure 22:
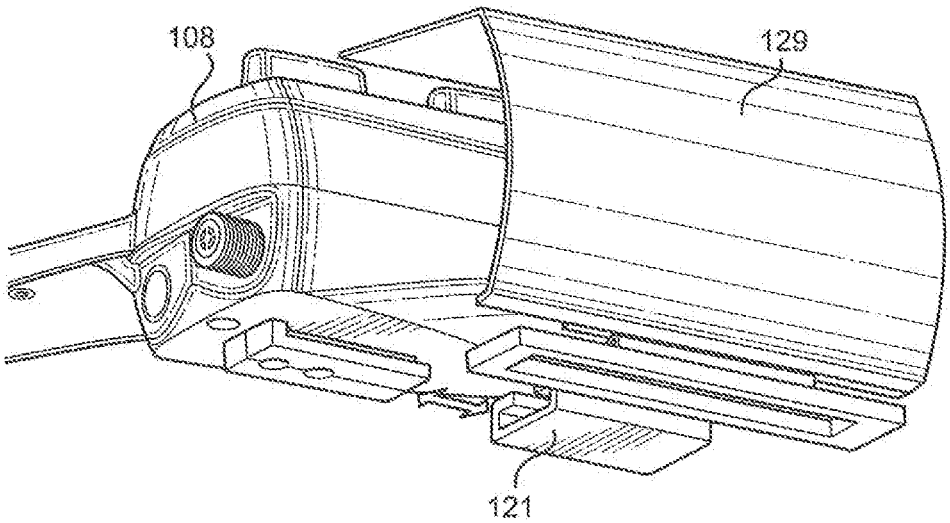
FIG. 22 illustrates an embodiment of a perspective view of the slider unit and toilet paper holder reversibly attaching to the rail connected to the underside of the control unit of the bidet.

FIG. 22 illustrates an embodiment of a perspective view of the slider unit and toilet paper holder reversibly attaching to the rail connected to the underside of the control unit of the bidet. As shown in this figure, the slider unit is a complementary hollow T-bar shaped slider unit 121, which can be connected to a bathroom accessory unit such as a toilet paper holder 130, and be reversibly attachable to the rail, i.e. the solid T-bar shaped rail unit 122.

Figure 23:
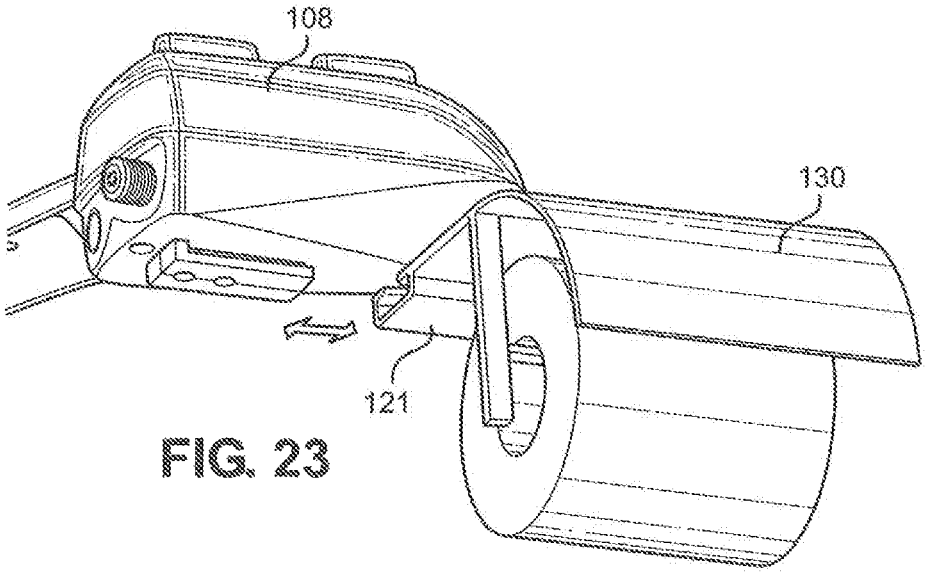
FIG. 23 illustrates an embodiment of a perspective view of the slider unit and control unit cover reversibly attaching to the rail connected to the underside of the control unit of the bidet.

FIG. 23 illustrates an embodiment of a perspective view of the slider unit and control unit cover reversibly attaching to the rail connected to the underside of the control unit of the bidet. As shown in this figure, the slider unit is a complementary hollow T-bar shaped slider unit 121, which can be connected to a bathroom accessory unit such as a cover 129 for the control unit 108 of the bidet washing apparatus, and can be reversibly attachable to the rail, i.e. the solid T-bar shaped rail unit 122.

Figure 24:
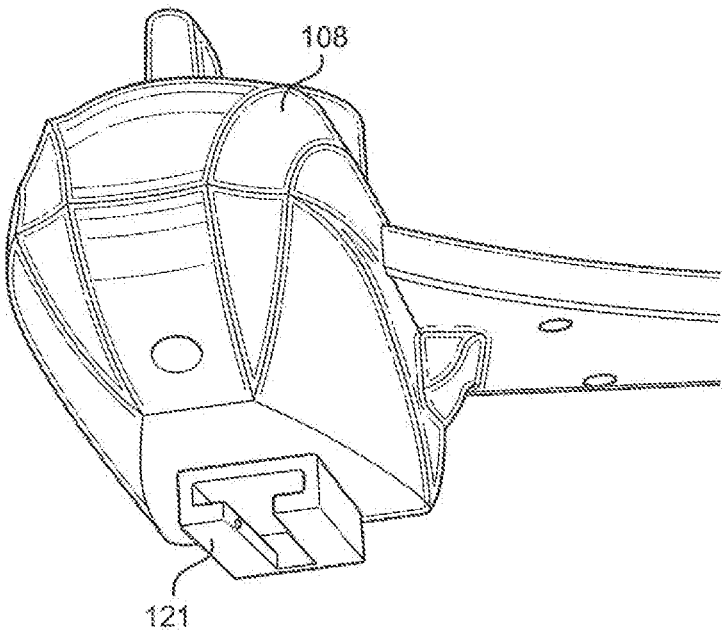
FIG. 24 illustrates an embodiment of a perspective view of a slider unit connected to an underside of the control unit of the bidet washing apparatus.

FIG. 24 illustrates an embodiment of a perspective view of a slider unit connected to the bottom of the control unit of the bidet washing apparatus. As shown in this figure, the slider unit is a complementary hollow T-bar shaped slider unit 121, which can be connected to the control unit through the use of screws holes and screws (not shown).

Figure 25:
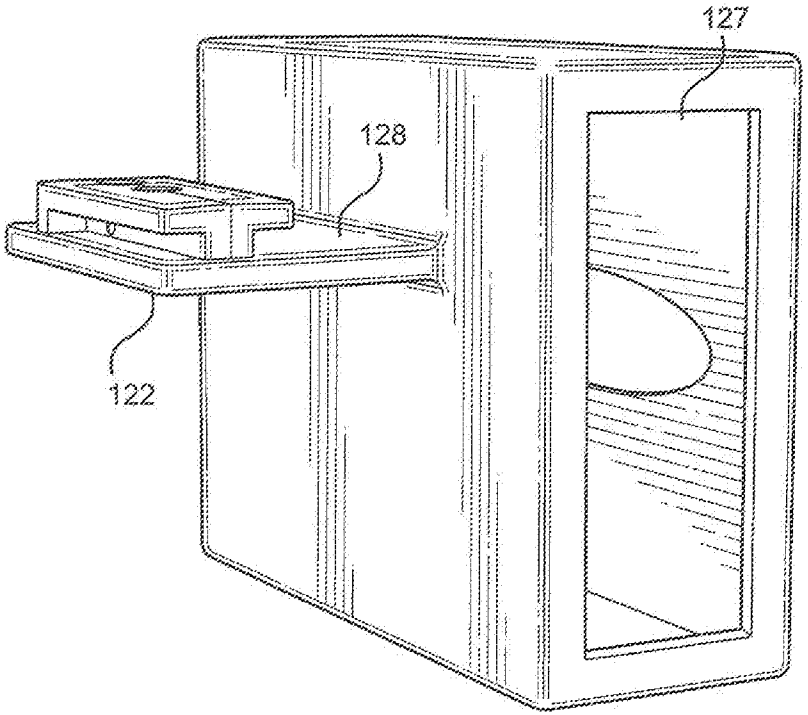
FIG. 25 illustrates an embodiment of a perspective view of the rail unit connected to a tissue box holder for holding tissues or a box of tissues.

FIG. 25 illustrates an embodiment of a perspective view of the rail unit connected to a tissue box holder for holding tissues or a box of tissues. As shown in this figure, the rail unit is a hollow T-bar shaped rail unit 122, which can be connected to a bathroom accessory unit such as a tissue box holder 127 via an extended side 128 of the unit and/or the tissue box holder. In some embodiments, the tissue box holder is reversibly attachable to the unit; and in other embodiments, the tissue box holder is permanently attachable to the unit so that it can be used as a single unit.

Figure 26:
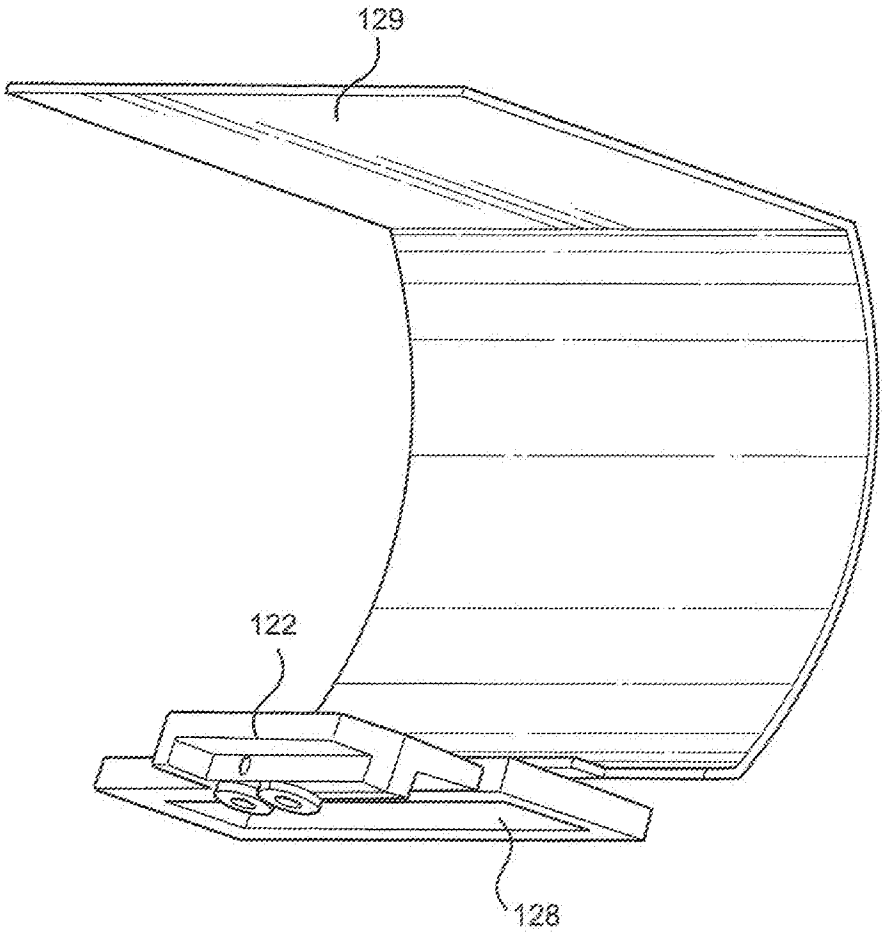
FIG. 26 illustrates an embodiment of a perspective view of the rail unit connected to a cover for protection of the control unit of the bidet washing apparatus.

FIG. 26 illustrates an embodiment of a perspective view of the rail unit connected to a cover for protection of the control unit of the bidet washing apparatus. As shown in this figure, the rail unit is a solid T-bar shaped rail unit 122, which can be connected to a bathroom accessory unit such as a cover 129 for the control unit of a bidet washing apparatus via an extended side 128 of the unit and/or the cover. In some embodiments, the cover is reversibly attachable to the unit; and in other embodiments, the cover is permanently attachable to the unit so that it can be used as a single unit.

Figure 27:
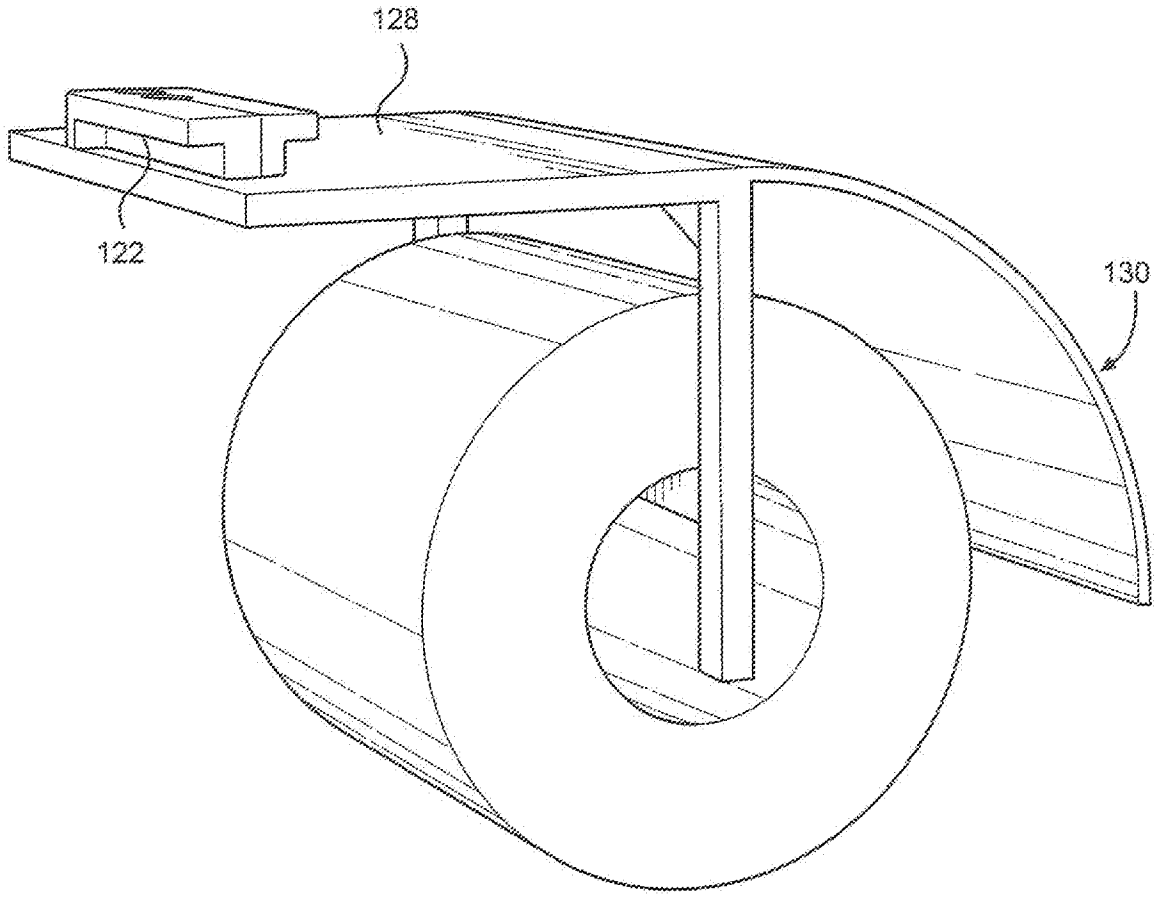
FIG. 27 illustrates an embodiment of a perspective view of the rail unit connected to a toilet paper holder for convenience of the user.

FIG. 27 illustrates an embodiment of a perspective view of the rail unit connected to a toilet paper holder for convenience of the user. As shown in this figure, the rail unit is a solid T-bar shaped rail unit 122, which can be connected to a bathroom accessory unit such as a toilet paper holder 130 via an extended side 128 of the unit and/or the holder. In some embodiments, the holder is reversibly attachable to the unit; and in other embodiments, the holder is permanently attachable to the unit so that it can be used as a single unit.

As a result of the foregoing description, a bidet washing apparatus is provided with an objective of satisfactorily and hygienically washing a user's body parts after toilet use. The protective shield gate, according to embodiments described herein, can provide advanced hygiene by protecting the nozzle(s) from excrement, while allowing for the easy cleaning and/or replacement of nozzle(s) as desired. Moreover, the single-body design of the connector between the water inlet(s) and the valve(s) provides for enhanced durability of the bidet washing apparatus, with decreased risk of leakage.

While the inventive features have been particularly shown and described with reference to preferred embodiments thereof, it will be understood by those in the art that the foregoing and other changes can be made therein without departing from the sprit and the scope of the disclosure. Likewise, the various diagrams may depict an example architectural or other configuration for the disclosure, which is done to aid in understanding the features and functionality that can be included in the disclosure. The disclosure is not restricted to the illustrated example architectures or configurations, but can be implemented using a variety of alternative architectures and configurations. Additionally, although the disclosure is described above in terms of various exemplary embodiments and implementations, it should be understood that the various features and functionality described in one or more of the individual embodiments are not limited in their applicability to the particular embodiment with which they are described. They instead can be applied alone or in some combination, to one or more of the other embodiments of the disclosure, whether or not such embodiments are described, and whether or not such features are presented as being a part of a described embodiment. Thus, the breadth and scope of the disclosure should not be limited by any of the above-described exemplary embodiments.

What is claimed is:

1. A device, comprising:

a bidet washing apparatus having a main body portion configured to be removably mounted on a toilet bowl and having a nozzle assembly;

a control unit connected to the main body via a laterally extending arm; and a universal port, wherein the universal port includes:

a solid rail unit having a proximal end and a distal end, wherein the rail unit includes a base having a raised bar shaped like the letter T, wherein a bottom of the raised bar is at the proximal end and a top of the raised bar is at the distal end; and a complimentary hollow slider unit having an open proximal end, a closed distal end, and a top end having an open channel therethrough that runs from the open proximal end to the closed distal end of the slider unit, wherein the slider unit is attachable to the rail unit, wherein the base of the rail unit can slide along the open proximal end to the close distal end of the slider unit, wherein the raised bar shaped like the letter T can slide within the open channel of the slider unit, and wherein one of said rail unit and said slider unit is attached to a bottom side of said control unit and the other of said rail unit and said slider unit is configured to be part of or attached to a bathroom accessory unit.

2. The device of claim 1, further comprising one or more bathroom accessory units attachable to the slider unit.

3. The device of claim 2, wherein the one or more bathroom accessory units include a tissue box holder, a toilet paper roll holder, a fragrance bottle holder, or an air freshener holder.

4. The device of claim 1, further comprising one or more holes rail unit and one or more screws for securing the rail unit to the bidet washing apparatus.

5. The device of claim 1, further comprising one or more holes in the distal end of the rail unit and one or more snaps in the proximal end of the slider unit.

6. The device of claim 5, wherein the one or more holes in the distal end of the rail unit receives the one or more snaps in the proximal end of the slider unit.

7. The device of claim 1, further comprising one or more holes in the proximal end of the slider unit and one or more snaps in the distal end of the rail unit.

8. The device of claim 7, wherein the one or more holes in the proximal end of the slider unit receives the one or more snaps in the distal end of the rail unit.

9. The device of claim 1, wherein the rail unit is attached to a bottom side of the bidet washing apparatus.

10. A method of attaching a bathroom accessory unit to a bidet washing apparatus, comprising:

mounting a main body portion of said bidet washing apparatus on a toilet bowl, said main body portion having a nozzle assembly and a control unit connected to the main body via a laterally extending arm;

attaching one or more bathroom accessory units to the bidet washing apparatus using a universal port, wherein the universal port includes:

a solid rail unit having a proximal end and a distal end, wherein the rail unit includes a base having a raised bar shaped like the letter T, wherein a bottom of the raised bar is at the proximal end and a top of the raised bar is at the distal end; and a complimentary hollow slider unit having an open proximal end, a closed distal end, and a top end having an open channel therethrough that runs from the open proximal end to the closed distal end of the slider unit, wherein the slider unit is attachable to the rail unit, wherein the base of the rail unit can slide along the open proximal end to the close distal end of the slider unit, wherein the raised bar shaped like the letter T can slide within the open channel of the slider unit, and wherein one of said rail unit and said slider unit is attached to a bottom side of said control unit and the other of said rail unit and said slider unit is part of or attached to said bathroom accessory unit.

11. The method of attaching a bathroom accessory unit to a bidet washing apparatus of claim 10, wherein the one or more bathroom accessory units include a tissue box holder, a toilet paper roll holder, a fragrance bottle holder, or an air freshener holder.

* * * * *